US011567420B2

(12) United States Patent
Mikami et al.

(10) Patent No.: US 11,567,420 B2
(45) Date of Patent: Jan. 31, 2023

(54) READING APPARATUS

(71) Applicant: CANON KABUSHIKI KAISHA, Tokyo (JP)

(72) Inventors: Ryo Mikami, Tokyo (JP); Hirotaka Seki, Tokyo (JP); Takeyuki Suda, Chiba (JP); Shinichi Isozaki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/586,636

(22) Filed: Jan. 27, 2022

(65) Prior Publication Data

US 2022/0244657 A1 Aug. 4, 2022

(30) Foreign Application Priority Data

Feb. 4, 2021 (JP) ..... JP2021-016512

(51) Int. Cl.
*G03G 15/00* (2006.01)
*G03G 15/01* (2006.01)

(52) U.S. Cl.
CPC ..... *G03G 15/0131* (2013.01); *G03G 15/5054* (2013.01); *G03G 15/5062* (2013.01)

(58) Field of Classification Search
CPC ..... G03G 15/0131; G03G 15/5054; G03G 15/5058; G03G 15/5062
See application file for complete search history.

(56) References Cited

U.S. PATENT DOCUMENTS

| | | | | |
|---|---|---|---|---|
| 11,106,153 | B2 * | 8/2021 | Yoshida | G03G 15/043 |
| 2012/0050771 | A1 | 3/2012 | Sakatani | |
| 2018/0004111 | A1 * | 1/2018 | Tamura | G03G 15/6561 |

* cited by examiner

*Primary Examiner* — Hoang X Ngo
(74) *Attorney, Agent, or Firm* — Canon U.S.A., Inc. IP Division

(57) ABSTRACT

There is provided a reading apparatus that includes a conveyance roller, a light source, a light transmission member, a line sensor having a plurality of pixels and configured to receive reflected light from a sheet via the light transmission member while the sheet is conveyed by the conveyance roller, and a controller. The controller is configured to perform acquiring an output value of a first pixel, an output value of a second pixel, and an output value of a third pixel, determine a first value based on the output value of the second pixel and a first coefficient, determine a second value based on the output value of the third pixel and a second coefficient, and determine read data based on the output value of the first pixel, the first value, and the second value. The first coefficient is larger than the second coefficient.

6 Claims, 25 Drawing Sheets

FIG.10

| MARGIN AMOUNT (mm) | AVERAGE LUMINANCE VALUE CORRECTION RATE (%) |
|---|---|
| 0 | 110 |
| — | — |
| 2.0 | 105 |
| 2.1 | 104 |
| 2.2 | 103 |
| 2.3 | 102 |
| 2.4 | 101 |
| 2.5 | 100 |
| 2.6 | 99 |
| 2.7 | 98 |
| 2.8 | 97 |
| 2.9 | 96 |
| 3.0 | 95 |

FIG.17

MAIN SCANNING PIXEL

| | 1 | 2 | 3 | 4 | 5 | 378 | 379 | 380 | 381 | 382 | 383 |
|---|---|---|---|---|---|---|---|---|---|---|---|
| 1 | 0.9 | 0.898 | 0.895 | 0.893 | 0.891 | 0.016 | 0.014 | 0.012 | 0.009 | 0.007 | 0.005 |
| 2 | 0.902 | 0.900 | 0.897 | 0.895 | 0.893 | 0.000 | 0.000 | 0.000 | 0.000 | 0.000 | 0.000 |
| 3 | 0.904 | 0.902 | 0.899 | 0.897 | 0.895 | 0.000 | 0.000 | 0.000 | 0.000 | 0.000 | 0.000 |
| 4 | 0.906 | 0.904 | 0.901 | 0.899 | 0.897 | 0.000 | 0.000 | 0.000 | 0.000 | 0.000 | 0.000 |
| 5 | 0.908 | 0.906 | 0.903 | 0.901 | 0.899 | 0.000 | 0.000 | 0.000 | 0.000 | 0.000 | 0.000 |
| 6 | 0.910 | 0.908 | 0.905 | 0.903 | 0.901 | 0.000 | 0.000 | 0.000 | 0.000 | 0.000 | 0.000 |
| 7 | 0.912 | 0.910 | 0.907 | 0.905 | 0.903 | 0.000 | 0.000 | 0.000 | 0.000 | 0.000 | 0.000 |
| 8 | 0.914 | 0.912 | 0.909 | 0.907 | 0.904 | 0.000 | 0.000 | 0.000 | 0.000 | 0.000 | 0.000 |
| 9 | 0.916 | 0.914 | 0.911 | 0.909 | 0.906 | 0.000 | 0.000 | 0.000 | 0.000 | 0.000 | 0.000 |
| 10 | 0.918 | 0.916 | 0.913 | 0.911 | 0.908 | 0.000 | 0.000 | 0.000 | 0.000 | 0.000 | 0.000 |
| 11 | 0.920 | 0.918 | 0.915 | 0.913 | 0.910 | 0.000 | 0.000 | 0.000 | 0.000 | 0.000 | 0.000 |
| 45 | 0.988 | 0.985 | 0.983 | 0.980 | 0.978 | 0.018 | 0.015 | 0.013 | 0.010 | 0.008 | 0.005 |
| 46 | 0.990 | 0.987 | 0.985 | 0.982 | 0.980 | 0.018 | 0.015 | 0.013 | 0.010 | 0.008 | 0.005 |
| 47 | 0.992 | 0.989 | 0.987 | 0.984 | 0.982 | 0.018 | 0.016 | 0.013 | 0.010 | 0.008 | 0.005 |
| 48 | 0.994 | 0.991 | 0.989 | 0.986 | 0.984 | 0.018 | 0.016 | 0.013 | 0.010 | 0.008 | 0.005 |
| 49 | 0.996 | 0.993 | 0.991 | 0.988 | 0.986 | 0.018 | 0.016 | 0.013 | 0.010 | 0.008 | 0.005 |
| 50 | 1.000 | 0.997 | 0.995 | 0.992 | 0.990 | 0.018 | 0.016 | 0.013 | 0.010 | 0.008 | 0.005 |
| 51 | 0.998 | 0.995 | 0.993 | 0.990 | 0.988 | 0.018 | 0.016 | 0.013 | 0.010 | 0.008 | 0.005 |
| 52 | 0.998 | 0.995 | 0.993 | 0.990 | 0.988 | 0.018 | 0.016 | 0.013 | 0.010 | 0.008 | 0.005 |
| 53 | 0.996 | 0.993 | 0.991 | 0.988 | 0.986 | 0.018 | 0.016 | 0.013 | 0.010 | 0.008 | 0.005 |
| 54 | 0.994 | 0.991 | 0.989 | 0.986 | 0.984 | 0.018 | 0.016 | 0.013 | 0.010 | 0.008 | 0.005 |
| 55 | 0.992 | 0.989 | 0.987 | 0.984 | 0.982 | 0.018 | 0.016 | 0.013 | 0.010 | 0.008 | 0.005 |

SUB SCANNING LINE

. . .

. . .

FIG.25

| DIVISION REGION | MAIN SCANNING WIDTH | DISTANCE CHARACTERISTICS | | DISTANCE COEFFICIENT | DISTANCE AREA COEFFICIENT |
|---|---|---|---|---|---|
| | | Vn | Vn+1 | | |
| 1 | 0.677 | 1.000 | 0.888 | 0.944 | 0.639 |
| 2 | 0.677 | 0.888 | 0.784 | 0.836 | 0.566 |
| 3 | 0.677 | 0.784 | 0.702 | 0.743 | 0.503 |
| 4 | 0.677 | 0.702 | 0.628 | 0.665 | 0.450 |
| 5 | 0.677 | 0.628 | 0.585 | 0.606 | 0.411 |
| 6 | 0.677 | 0.585 | 0.474 | 0.529 | 0.359 |
| 7 | 1.355 | 0.474 | 0.341 | 0.407 | 0.552 |
| 8 | 1.355 | 0.341 | 0.239 | 0.290 | 0.392 |
| 9 | 1.355 | 0.239 | 0.211 | 0.225 | 0.305 |
| 10 | 1.355 | 0.211 | 0.182 | 0.197 | 0.266 |
| 11 | 1.355 | 0.182 | 0.158 | 0.170 | 0.230 |
| 12 | 2.709 | 0.158 | 0.093 | 0.126 | 0.340 |
| 13 | 2.709 | 0.093 | 0.070 | 0.081 | 0.220 |
| 14 | 2.709 | 0.070 | 0.050 | 0.060 | 0.163 |
| 15 | 2.709 | 0.050 | 0.025 | 0.038 | 0.102 |
| 16 | 2.709 | 0.025 | 0.000 | 0.013 | 0.034 |

* CONVERTED TO 300 DPI (UNIT: MM), n = 1 TO 16

READING APPARATUS

BACKGROUND

Field of the Disclosure

The aspect of the embodiments relates to a technique for improving reading accuracy of a reading apparatus that reads a test image formed together with a user image on a sheet.

Description of the Related Art

Image forming apparatuses that form an image by using an electrophotographic process have an issue that characteristics in charging, developing, and transfer processes are affected by aging or environmental variations, and consequently density of output images is also changed.

To address the issue, image forming apparatuses generally perform what is called image stabilization control. In the image stabilization control, a pattern image is formed on a photosensitive drum or an intermediate transfer belt. The pattern image is detected by an optical sensor, and image forming conditions are adjusted based on a result of the detection so that an output image has a suitable density. Examples of the image forming conditions include an image carrier charging amount and a light emission energy amount.

However, since such image stabilization control uses density information obtained before a toner image is transferred to a recording material, factors that affect density after transfer is uncontrollable. Examples of uncontrollable factors include a change in transfer efficiency of a toner image from the photosensitive drum or the intermediate transfer belt to a recording material due to an influence of environmental variations. This issue poses density variations in output images.

U.S. Patent Application Publication No. 2012/0050771 discusses a control method for forming a pattern image on a margin around a cutting position of a recording material, detecting the pattern image by using an optical sensor provided on a downstream part of a fixing apparatus, and adjusting image forming conditions of an image forming apparatus based on a result of the detection.

SUMMARY OF THE DISCLOSURE

According to an aspect of the embodiments, a reading apparatus includes a conveyance roller configured to convey a sheet, a light source configured to illuminate the sheet conveyed by the conveyance roller, a light transmission member configured to transmit reflected light from the sheet conveyed by the conveyance roller, a line sensor configured to receive the reflected light from the sheet via the light transmission member while the sheet is being conveyed by the conveyance roller, wherein a predetermined direction in which a plurality of pixels of the line sensor is arranged is different from a conveyance direction in which the sheet is conveyed, wherein each of the plurality of pixels outputs output value based on a result of receiving, and a controller configured to acquire an output value of a first pixel included in the plurality of pixels of the line sensor, wherein a position of the first pixel in the predetermined direction corresponds to a position in a range where a pattern image on the sheet conveyed by the conveyance roller passes through in the predetermined direction, acquire an output value of a second pixel included in the plurality of pixels of the line sensor, wherein a position of the second pixel in the predetermined direction is apart from the range where the pattern image on the sheet conveyed by the conveyance roller passes through in the predetermined direction, by a first distance, acquire an output value of a third pixel included in the plurality of pixels of the line sensor, wherein a position of the third pixel in the predetermined direction is apart from the range where the pattern image on the sheet conveyed by the conveyance roller passes through in the predetermined direction, by a second distance longer than the first distance, determine a first value based on the output value of the second pixel and a first coefficient for the first distance, determine a second value based on the output value of the third pixel and a second coefficient for the second distance, and determine read data of the pattern image based on the output value of the first pixel, the first value, and the second value.

Further features of the disclosure will become apparent from the following description of exemplary embodiments with reference to the attached drawings.

BRIEF DESCRIPTION OF THE DRAWINGS

FIG. 10 is a table illustrating an example of a correction table.

FIG. 17 is a table illustrating examples of coefficients for pixels.

FIG. 25 is a table illustrating examples of a distance coefficient and a distance area coefficient.

DESCRIPTION OF THE EMBODIMENTS

Figure 1:
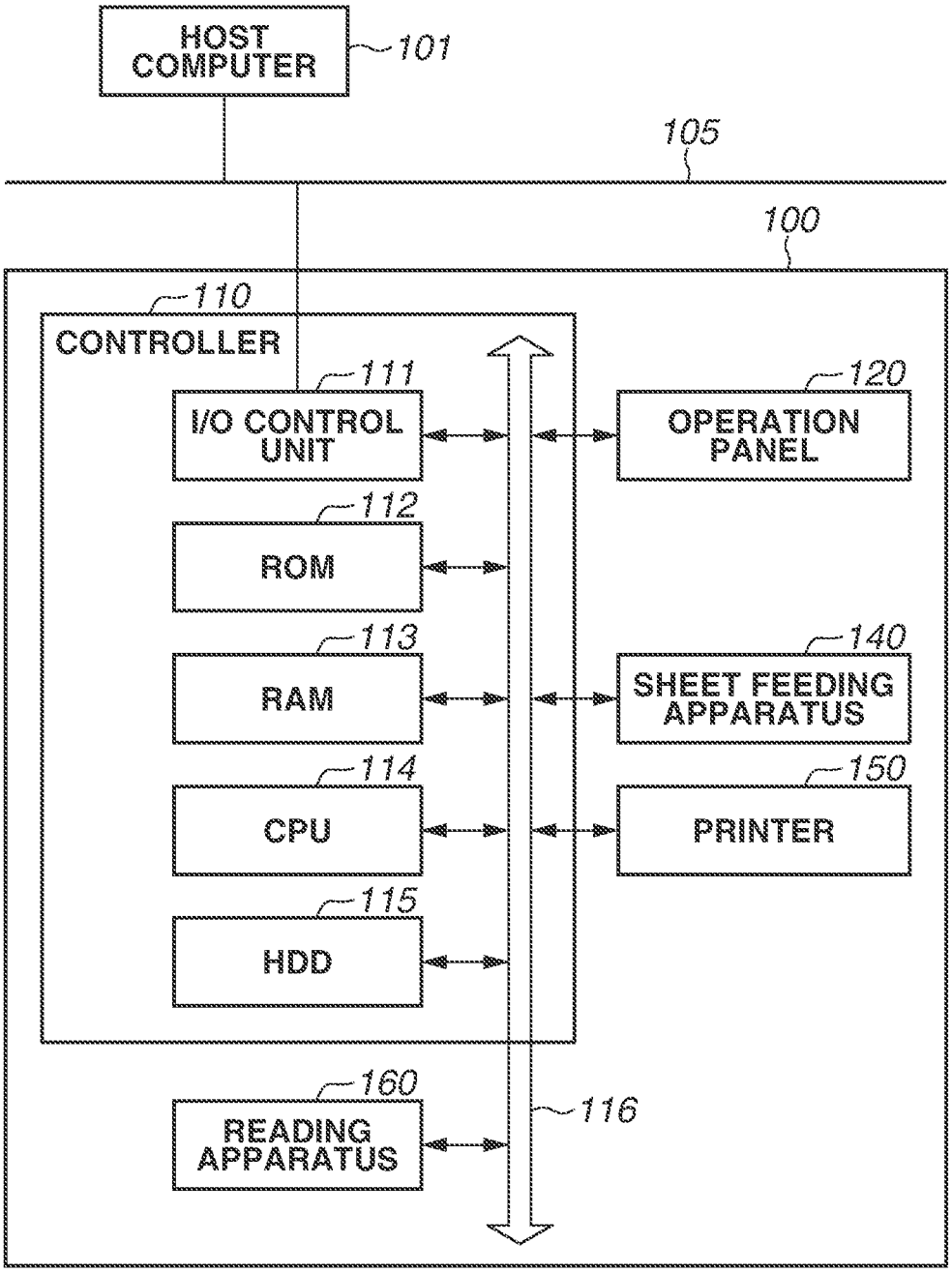
FIG. 1 is a control block diagram illustrating an image forming apparatus having a reading apparatus.

FIG. 1 illustrates an overall configuration of a printing system having an image forming apparatus 100 according to a first exemplary embodiment. The printing system includes the image forming apparatus 100 and a host computer 101. The image forming apparatus 100 and the host computer 101 are connected with each other to communicate via a network 105. For example, the network 105 is a communication line such as a Local Area Network (LAN) and a Wide Area Network (WAN). A plurality of the image forming apparatuses 100 and a plurality of the host computers 101 may be connected to the network 105.

For example, the host computer 101 is a server that transmits a print job to the image forming apparatus 100 via the network 105. A print job includes various information for printing, such as image data, a type of a recording material to be used for printing, the number of copies to be printed, and a two-sided or one-sided printing instruction.

The image forming apparatus 100 includes a controller 110, an operation panel 120, a sheet feeding apparatus 140, a printer 150 and a reading apparatus 160. The image forming apparatus 100 forms an image on the recording material based on the print job acquired from the host computer 101. The controller 110, the operation panel 120, the sheet feeding apparatus 140, the printer 150, and the reading apparatus 160 are connected via a system bus 116 to communicate with each other.

The controller 110 controls each unit of the image forming apparatus 100. The operation panel 120 as a user interface is provided with operation buttons, a numeric keypad, and a Liquid Crystal Display (LCD). The user can input print jobs, commands, and print settings to the image forming apparatus 100 by using the operation panel 120. The operation panel 120 displays setting screens and statuses of the image forming apparatus 100 on the LCD.

The sheet feeding apparatus 140 includes a plurality of sheet feeding cassettes for storing recording materials. The sheet feeding apparatus 140 sequentially supplies recording materials one by one from the uppermost recording material of a bundle of recording materials stacked on each of the plurality of sheet feeding cassettes. The sheet feeding apparatus 140 conveys a recording material supplied from the plurality of sheet feeding cassettes to the printer 150.

The printer 150 forms an image on the recording material supplied from the sheet feeding apparatus 140 based on image data. A specific configuration of the printer 150 will be described below with reference to FIG. 2.

The reading apparatus 160 reads a print product generated by the printer 150 and transfers a result of the reading to the controller 110.

The configuration of the controller 110 will be described below. The controller 110 includes a read only memory (ROM) 112, a random access memory (RAM) 113, and a central processing unit (CPU) 114. The controller 110 further includes an input/output (I/O) control unit 111 and a hard disk drive (HDD) 115.

The I/O control unit 111 is an interface that controls communication between the host computer 101 and other apparatuses via the network 105. The ROM 112 is a storage device for storing various control programs. The RAM 113 functions as a system work memory that reads and stores a control program stored in the ROM 112. The CPU 114 executes the control program loaded into the RAM 113 to perform overall control of the image forming apparatus 100. The HDD 115 is a mass storage device for storing control programs and various data, such as image data, to be used for image forming processing (print processing). These modules are connected with each other via the system bus 116.

Figure 2:
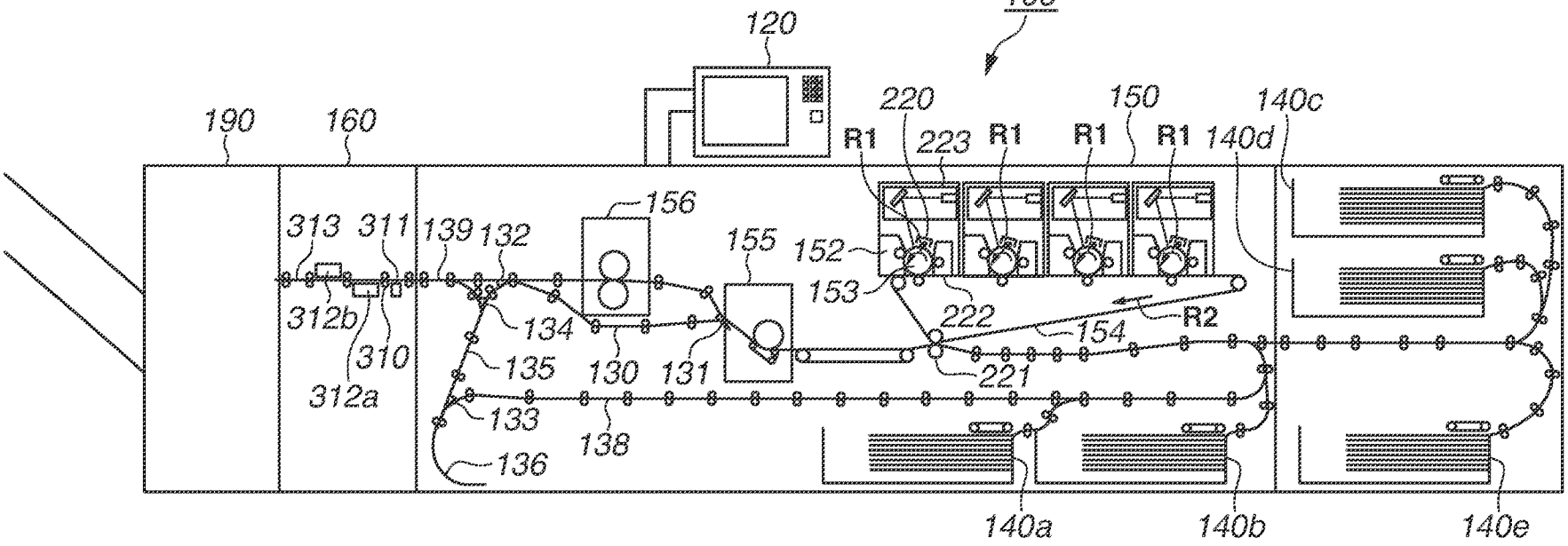
FIG. 2 is a cross-sectional view schematically illustrating the image forming apparatus.

FIG. 2 is a cross-sectional view schematically illustrating the image forming apparatus 100. The image forming apparatus 100 includes the sheet feeding apparatus 140, the printer 150, the reading apparatus 160, and a finisher 190. The finisher 190 is a post-processing apparatus that performs post-processing on a print product of the printer 150. The finisher 190 performs, for example, stapling processing and sorting processing on a plurality of print products.

As illustrated in FIG. 1, the printer 150 includes four image forming units. The plurality of image forming units includes an image forming unit for forming a yellow image, an image forming unit for forming a magenta image, an image forming unit for forming a cyan image, and an image forming unit for forming a black image. The image forming units have approximately the same configuration.

Each of the image forming units includes a photosensitive drum 153, a charging device 220, an exposure device 223, and a development device 152. The photosensitive drum 153 rotates by a motor (not illustrated) in a direction indicated by an arrow R1. The charging device 220 charges the surface of the photosensitive drum 153. The exposure device 223 exposes the photosensitive drum 153 to light, to form an electrostatic latent image on the photosensitive drum 153. The development device 152 develops the electrostatic latent image using a developer (toner). This process visualizes the electrostatic latent image on the photosensitive drum 153 to form an image on the photosensitive drum 153.

The printer 150 includes an intermediate transfer belt 154 on which images formed by the image forming units are transferred, and the sheet feeding apparatus 140. The sheet feeding apparatus 140 includes sheet feeding cassettes 140*a*, 140*b*, 140*c*, 140*d*, and 140*e* that store recording materials. The printer 150 transfers a yellow image, a magenta image, a cyan image, and a black image formed by the respective image forming units to the intermediate transfer belt 154 so that the images are superimposed one another. Thus, a full-color image is formed on the intermediate transfer belt 154. The image formed on the intermediate transfer belt 154 is conveyed in a direction indicated by an arrow R2. Then, the image formed on the intermediate transfer belt 154 is transferred to the recording material conveyed from the sheet feeding apparatus 140 at a nip portion formed between the intermediate transfer belt 154 and a transfer roller 221.

The printer 150 includes a first fixing device 155 and a second fixing device 156 that heat and pressurize the image transferred on the recording material to fix the image to the recording material. The first fixing device 155 includes fixing rollers incorporating a heater, and a pressurizing belt that pressurizes the recording material to the fixing rollers. These rollers are driven by a motor (not illustrated) to convey the recording material. The second fixing device 156 is disposed downstream of the first fixing device 155 in a conveyance direction of the recording material. The second fixing device 156 provides a gloss to the image on the recording material that passed through the first fixing device 155 and enhances fixing characteristics. The second fixing device 156 includes a fixing roller incorporating a heater, and a pressure roller incorporating a heater. The second fixing device 156 is not used depending on a type of the recording material. In such a case, the recording material is conveyed to a conveyance path 130 without passing through the second fixing device 156. A flapper 131 switches a guiding destination for the recording material between the conveyance path 130 and the second fixing device 156.

A flapper 132 switches the guiding destination for the recording material between a conveyance path 135 and a discharge path 139. More specifically, the flapper 132 guides the recording material with an image formed on a first surface of the recording material to the conveyance path 135 in a two-sided print mode. In another example, the flapper 132 guides the recording material with an image formed on the first surface to the discharge path 139 in a face-up discharge mode. In yet another example, the flapper 132 guides the recording material with an image formed on the first surface to the conveyance path 135 in a face-down discharge mode. After an image is printed on the first surface of the recording material, the flapper 132 also guides the recording material to the conveyance path 135 to print an image on a second surface of the recording material.

The recording material conveyed to the conveyance path 135 is conveyed to an inversing portion 136. When the recording material is conveyed to the inversing portion 136, the conveyance operation temporarily stops. Then, the conveyance direction of the recording material is changed backward to convey the recording material in the opposite direction. Then, a flapper 133 switches the guiding destination for the recording material between a conveyance path 138 and the conveyance path 135. More specifically, the flapper 133 guides the recording material of which conveyance direction has been switched backward, to the conveyance path 138 in the two-sided print mode. In another example, the flapper 133 guides the recording material of which conveyance direction has been switched backward, to the conveyance path 135 in the face-down discharge mode. The recording material conveyed to the conveyance path 135 by the flapper 133 is guided to the discharge path 139 by a flapper 134. The flapper 133 also guides the recording material of which conveyance direction has been switched backward, to the conveyance path 138 to print an image on the second surface of the recording material.

The recording material conveyed to the conveyance path 138 by the flapper 133 is conveyed to the nip portion formed between the intermediate transfer belt 154 and the transfer roller 221. Thus, the recording material of which front and back surfaces has been reversed passes through the nip portion.

The reading apparatus 160 that reads pattern images (referred to as density patches) printed outside a user image region on the recording material is connected downstream of the printer 150 in the conveyance direction of the recording material. The recording material supplied from the printer 150 to the reading apparatus 160 is conveyed along the conveyance path 313 by using a conveyance roller 310. The reading apparatus 160 further includes a document detection sensor 311 and line sensor units 312*a* and 312*b*. The reading apparatus 160 reads the recording material on which density patches have been printed by the printer 150, by the line sensor units 312*a* and 312*b* while conveying the recording material along the conveyance path 313. The recording material on which density patches have been printed will be illustrated in detail below with reference to FIG. 6.

For example, the document detection sensor 311 is an optical sensor having a light-emitting element and a light-receiving element.

The document detection sensor 311 detects a leading edge of a test sheet (recording material) conveyed along the conveyance path 313 in the conveyance direction. The controller 110 starts a read operation of the reading apparatus 160 based on a timing when the document detection sensor 311 detects the leading edge of the recording material.

The line sensor units 312*a* and 312*b* read the density patches on the recording material. The density patches are printed on the first surface or the second surface of the recording material which is conveyed along the conveyance path 313. The line sensor units 312*a* and 312*b* are disposed at positions where the conveyance path 313 runs between the line sensor units 312*a* and 312*b*. The line sensor unit 312*a* reads the density patches formed on the first surface of the recording material passing through the conveyance path 313, and the line sensor unit 312*b* reads the density patches formed on the second surface (the back side of the first surface) of the recording material passing through the conveyance path 313. In a case where print density adjustment is performed, the image forming apparatus 100 acquires results of reading the density patches from the line sensor units 312*a* and 312*b* to determine an image forming condition for adjusting density of an image to be formed by the image forming apparatus 100. For example, the controller 110 generates a look-up table for converting signal values of image data included in a print job, based on the results of reading the density patches. Then, to output a print image with a suitable density, the controller 110 converts the image data in accordance with the look-up table and performs image forming processing based on the converted image data.

(System Configuration of Reading Apparatus)

Figure 3:
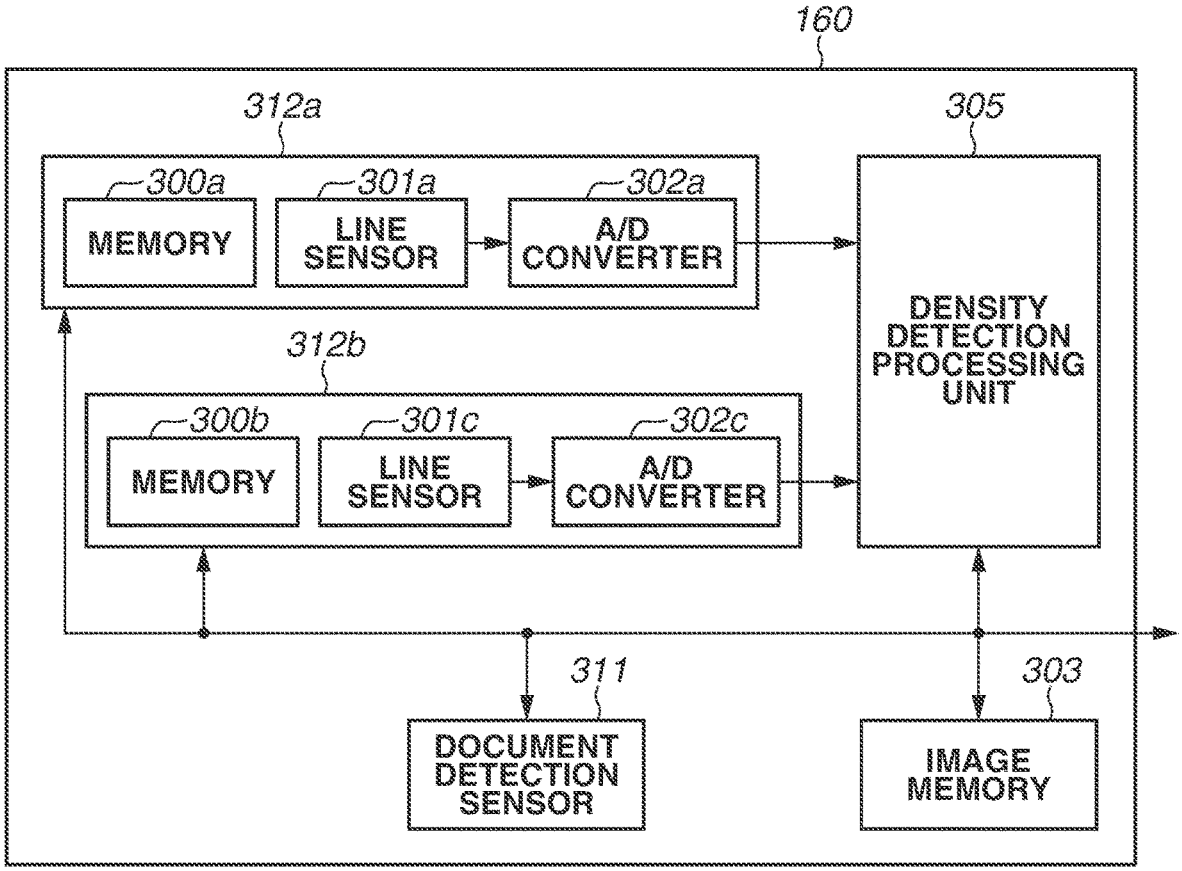
FIG. 3 is a control block diagram illustrating the reading apparatus.

FIG. 3 illustrates a system configuration of the reading apparatus 160.

The line sensor units 312*a* and 312*b* include line sensors 301*a* and 301*c*, memories 300*a* and 300*b*, and analog-to-digital (AD) converters 302*a* and 302*c*, respectively. For example, the line sensors 301*a* and 301*c* are Contact Image Sensors (CIS's). The memories 300*a* and 300*b* store correction information, such as a light amount variation, a difference in height, and a distance between chips of the line sensors 301*a* and 301*c*, respectively. The AD converters 302*a* and 302*c* convert analog signals output from the line sensors 301*a* and 301*c* into digital signals, respectively, and output red, green, and blue (RGB) read data to a density detection processing unit 305. The density detection processing unit 305 outputs RGB average luminance values of density patches based on the RGB read data to the CPU 114. The density detection processing unit 305 includes a Field Programmable Gate Array (FPGA) and an Application Specific Integrated Circuit (ASIC). The line sensor units 312*a* and 312*b*, an image memory 303, the density detection processing unit 305, and the document detection sensor 311 are connected with the CPU 114, and each apparatus is controlled by the CPU 114. The image memory 303 is used as an apparatus for storing data for image processing in the CPU 114.

(Configuration of Line Sensors)

Figure 4:
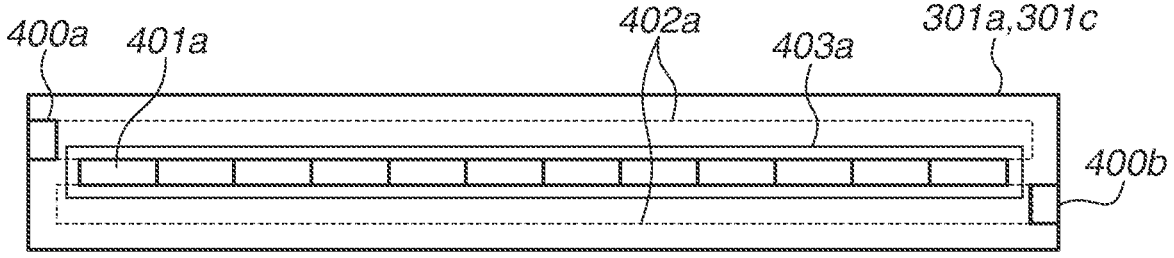
FIG. 4 is a schematic view illustrating a line sensor.

FIG. 4 is a block diagram illustrating the line sensors 301*a* and 301*c*.

The line sensors 301*a* and 301*c* include light emitting diodes (LEDs) 400*a* and 400*b*, a light guide member 402*a*, a lens array 403*a*, and a sensor chip group 401*a*.

The LEDs 400*a* and 400*b* as light sources include LEDs for emitting white light. The light guide member 402*a* is a document irradiation unit. The LEDs 400*a* and 400*b* are disposed at both ends of the light guide member 402*a*. The line sensors 301*a* and 301*c* include the lens array 403*a* and the sensor chip group 401*a*. The sensor chip group 401*a* has a 3-line configuration and is applied with RGB color filters.

Light emitted by the LEDs 400*a* and 400*b* scatters into the light guide member 402*a* up to the side where no LED is attached, and is emitted from a portion having a curvature to illuminate an entire main scanning region of a document. The line sensors 301*a* and 301*c* are configured to have a "two-sided illumination configuration" where light is radiated from two different directions, i.e., from a leading end and a trailing end, to a position corresponding to the lens array 403*a* (the document read line) in a sub scanning direction. The light emitted from the light guide member 402*a* is radiated onto the document, and the light diffused on the document passes through the lens array 403*a* and is formed on the sensor chip group 401*a*.

(Density Detection Control)

Figure 5:
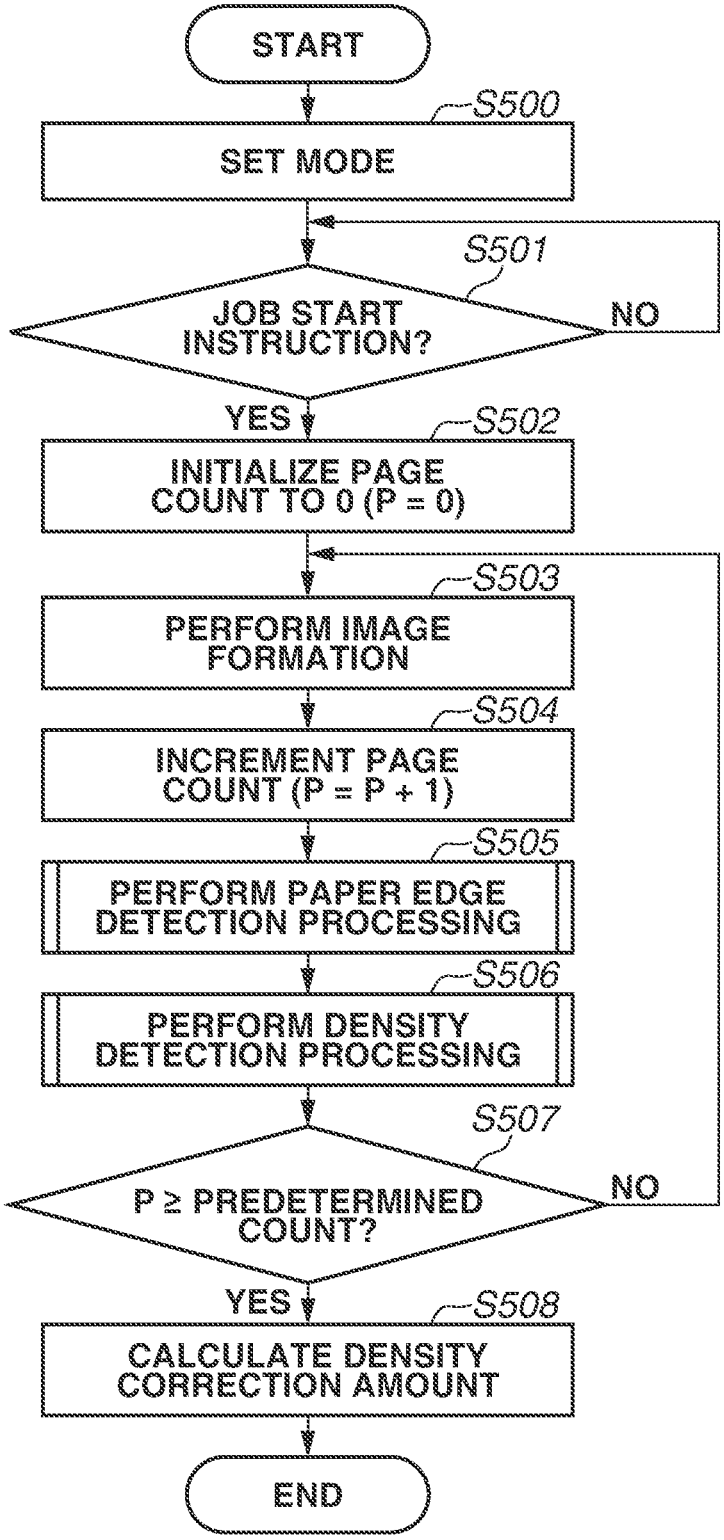
FIG. 5 is a flowchart illustrating image forming processing including density detection control.

FIG. 5 is a flowchart illustrating image forming processing including density detection control which is executed in response to an instruction from the CPU 114.

In step S500, in a case where the user specifies a document size and a print mode on the operation panel 120, the CPU 114 sets information for a print job including an image forming instruction and image data to each apparatus.

In step S501, the CPU 114 starts print processing according to the image forming instruction for the print job from the host computer 101. In step S502, the CPU 114 initializes a page count value to 0 (P=0). In step S503, the CPU 114 generates image data of a user image to which density patches are added, to print the user image. This processing will be described in detail below.

In step S504, the CPU 114 detects a leading edge of a test sheet by using the document detection sensor 311. The document detection sensor 311 changes a detected value from 0 to 1 at the timing of when the document detection sensor 311 detects the leading edge of the test sheet. Each time the detected value changes from 0 to 1, the CPU 114 increments a page count value P by one (page count value P=P+1).

In step S505, the CPU 114 detects edges of the recording material by using the line sensor units 312*a* and 312*b*. This processing will be described in detail below.

In step S506, the CPU 114 detects density values of the density patches on the recording material by using the line sensor units 312*a* and 312*b* and the density detection processing unit 305. While density values are detected in this case, luminance values may be detected. This processing will be described in detail below.

In a case where the page count value P becomes a predetermined number of sheets P1 or larger (YES in step S507), the processing proceeds to step S508. On the other hand, in a case where the page count value P is less than the predetermined number of sheets P1 (NO in step S507), the CPU 114 repetitively performs the processing in steps S503 to S507. The predetermined number of sheets P1 is a predetermined value.

In step S508, the CPU 114 calculates the edges of the recording material detected in step S505 and a margin amount. Based on a result of the calculation, the CPU 114 calculates a correction value for correcting a density shift of the user image from the density values of the density patches detected in step S506. For example, the CPU 114 obtains the correction value by calculating a difference between a reference density value and the detected density values (detected read values).

(Density Adjustment Chart)

Figure 6:
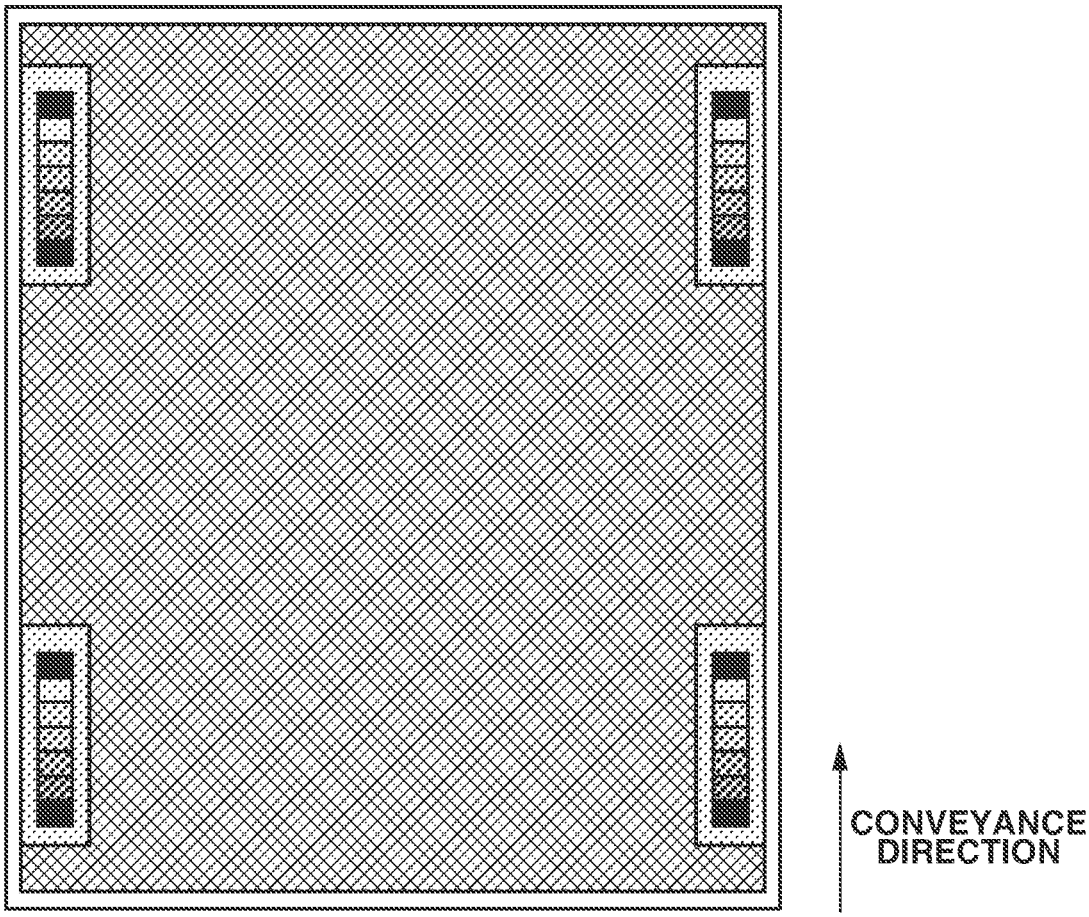
FIG. 6 is a schematic view illustrating a density adjustment chart.

An example of the density patches as a density adjustment chart added to the user image formed in step S503 will be described below with reference to FIG. 6.

The shaded portion is a region where an image instructed by the user is printed. The density patches for density adjustment are printed as illustrated in FIG. 6, more specifically, two density patches are formed on each of both edges of the recording material. Each of the density patches printed on both edges of the recording material may be any color of yellow, magenta, cyan, and black (YMCK) and are not limited to a specific color. When each of the Y, M, C, and K density patches is overlapped with the user image, the Y, M, C, and K density patches are given priority to the user image. The Y, M, C, and K density patches have gradual density variations. Among the density patches in each color, a first density patch has the highest density. More specifically, for the yellow density patch, the starting patch in the conveyance direction has a higher density than the following patches. This also applies to magenta, cyan, and black. The regions where the density patches are formed are cutting margins that will be eventually cut and discarded. Therefore, even in a case where the density patches are formed in the above-described regions, there arises no issue as a final print product. A predetermined peripheral range around each density patch is a white background region. To keep an influence of reflection from the user image to be constant, the white background region in the sub scanning direction is slightly widened to ensure a distance from the user image. The reflection will be described in detail below. The density patch forming positions are not limited thereto.

(Paper Edge Detection Processing)

Figure 7:
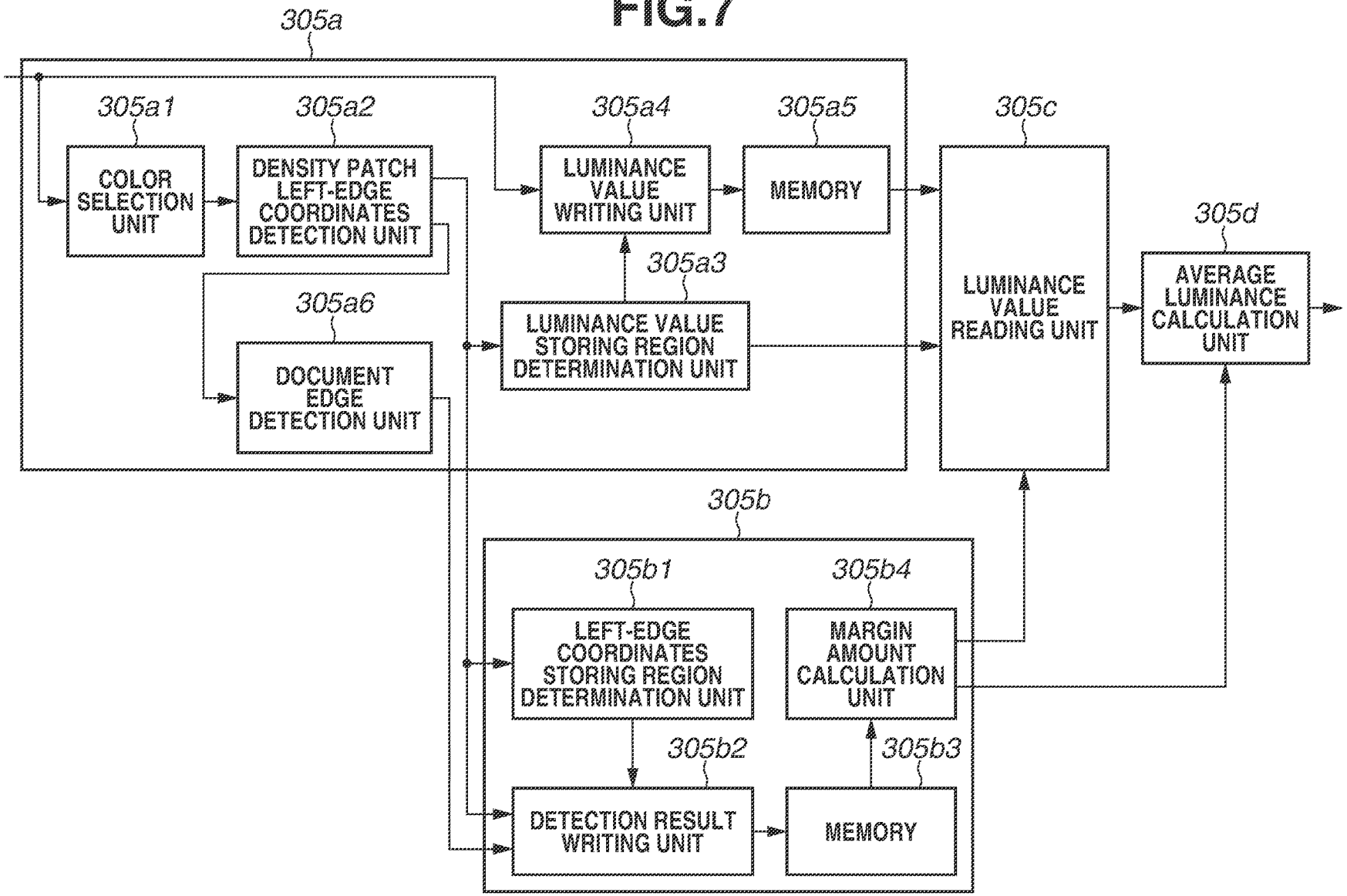
FIG. 7 is a function block diagram illustrating a density detection processing unit.

Paper edge detection processing in step S505 will be described below with reference to FIG. 7. FIG. 7 is a block diagram illustrating the density detection processing unit 305. Since the paper edge detection processing and density detection processing are common to the front and the back surfaces of the recording material, these pieces of processing will be described below centering on the front surface. The front surface refers to the front side of the recording material, and the back surface refers to the side opposite to the front surface.

The density detection processing unit 305 includes a luminance value storage unit 305*a*, a skew amount detection unit 305*b*, a luminance value reading unit 305*c*, and an average luminance calculation unit 305*d*.

The luminance value storage unit 305*a* stores read data output from the line sensors 301*a* and 301*c* in a memory 305*a*5 which is internally provided. The luminance value storage unit 305*a* includes a color selection unit 305*a*1, a density patch left-edge coordinates detection unit 305*a*2, a luminance value storing region determination unit 305*a*3, a luminance value writing unit 305*a*4, the memory 305*a*5, and a document edge detection unit 305*a*6.

The color selection unit 305*a*1 selects read data of one color from among the RGB image data output from the line sensors 301*a* and 301*c*. While any color can be selected, in one embodiment, a color in accordance with the color of paper is selected, to improve accuracy of left-edge coordinates detection.

The density patch left-edge coordinates detection unit 305*a*2 detects a left edge of each of the density patches based on the read data of one color output by the color selection unit 305*a*1. The density patch left-edge coordinates detection unit 305*a*2 performs the left-edge detection by using the read data of one color among the acquired RGB read data. More specifically, the density patch left-edge coordinates detection unit 305*a*2 detects the left edge by comparing the read data with a threshold value, sequentially from a first pixel forward for each pixel in the main scanning direction. Since luminance of the density patch is lower than luminance of the margin region of the recording material, the left edge of the density patch can be detected by detecting a point where the luminance value falls. In a case where detection accuracy for the left-edge coordinates is low, the density patch left-edge coordinates detection unit 305*a*2 may detect a point where the luminance values of a plurality of sub scanning lines fall, and detect coordinates based on the plurality of data pieces. Upon detection of the left edge of the density patch, the density patch left-edge coordinates detection unit 305*a*2 outputs a density patch detection signal to the document edge detection unit 305*a*6 (described below).

The luminance value storing region determination unit 305*a*3 determines a range of the main scanning and the sub scanning region for storing read data, based on first left-edge coordinates of the density patch output by the density patch left-edge coordinates detection unit 305*a*2. The luminance value storing region determination unit 305*a*3 determines the range of the main scanning and the sub scanning region for storing read data from the line sensor units 312*a* and 312*b* based on coordinates of the upper left edge of the density patch and the size of the density patch.

Figure 8A:
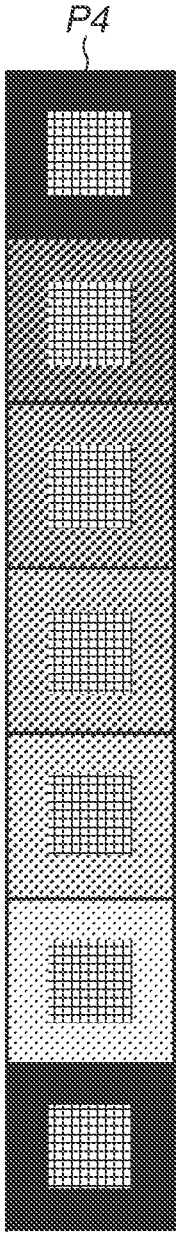
FIGS. 8A and 8B are schematic views illustrating recording regions.
Figure 8B:
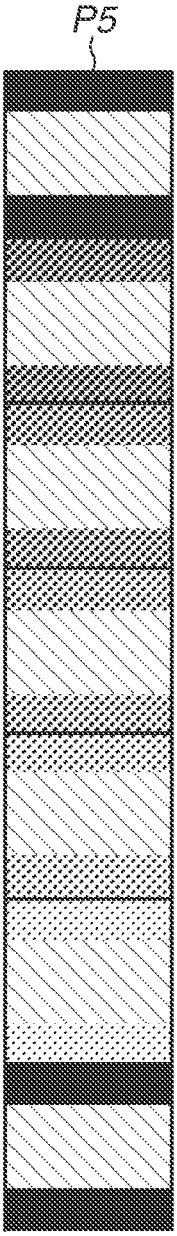

FIGS. 8A and 8B illustrate regions for storing the read data. Referring to FIG. 8A, shaded portions are subjected to average luminance value calculation. To eliminate an influence of flares due to peripheral images, the CPU 114 calculates an average value based only on a luminance value of the center portion for each density in the density patch, as illustrated in FIG. 8A. The shaded portions in FIG. 8B are regions which are determined by the luminance value storing region determination unit 305*a*3 as read data storing targets. These regions for the read data storing are regions set by enlarging a region for the average luminance value calculation in the main scanning direction. The reason why the regions for read data storing are larger than the regions for the average luminance value calculation is that the regions for the average luminance value calculation are adjusted based on a skew amount of the density patch with respect to CIS's. The reason why the regions for the read data storing are not enlarged in the sub scanning direction is that a skew amount has a small influence in the sub scanning direction and can be ignored. However, enlargement of the regions for the read data storing are not limited to the main scanning direction, the regions for the read data storing may be enlarged in both the main and the sub scanning directions.

Since the luminance value storing region determination unit 305*a*3 stores luminance values of regions determined in consideration of a skew amount without storing luminance values of all image regions in the density patches in this way, the capacity of the memory to be used can be minimized.

In the memory 305*a*5, the luminance value writing unit 305*a*4 writes RGB read data Ai and Dj obtained from the line sensor units 312*a* and 312*b*. The RGB read data Ai and Dj is data of the main scanning and the sub scanning regions determined by the luminance value storing region determination unit 305*a*3.

The document edge detection unit 305*a*6 detects document edges based on the read data of one color output by the color selection unit 305*a*1. In the document edge detection, the document edge detection unit 305*a*6 detects the left edge of the recording material by comparing the read data of one color among the acquired RGB read data with a threshold value, sequentially from the first pixel forward for each pixel in the main scanning direction. On the other hand, the document edge detection unit 305*a*6 detects the right edge of the recording material by comparing the read data with a threshold value, sequentially from the last pixel backward for each pixel in the main scanning direction. Since the back surface of the recording material has low luminance values and the recording material has high luminance values, the document edge detection unit 305*a*6 detects the right and the left edges of the recording material by detecting a point where the luminance values rises. In a case where edge detection accuracy for the recording material is low, the document edge detection unit 305*a*6 may detect coordinates of the edges of the recording material by detecting a point where luminance values of a plurality of sub scanning lines rises. The detection method is not limited to the above-described method as long as the edges of the recording material can be detected. Upon input of a density patch detection signal output from the density patch left-edge coordinates detection unit 305*a*2, the document edge detection unit 305*a*6 outputs a document edge detection result, i.e., the document edge coordinates at the time of density patch detection, to a left-edge coordinates writing unit 305*b*2.

The skew amount detection unit 305*b* includes a left-edge coordinates storing region determination unit 305*b*1, the left-edge coordinates writing unit 305*b*2, a memory 305*b*3, and a margin amount calculation unit 305*b*4.

Figure 9:
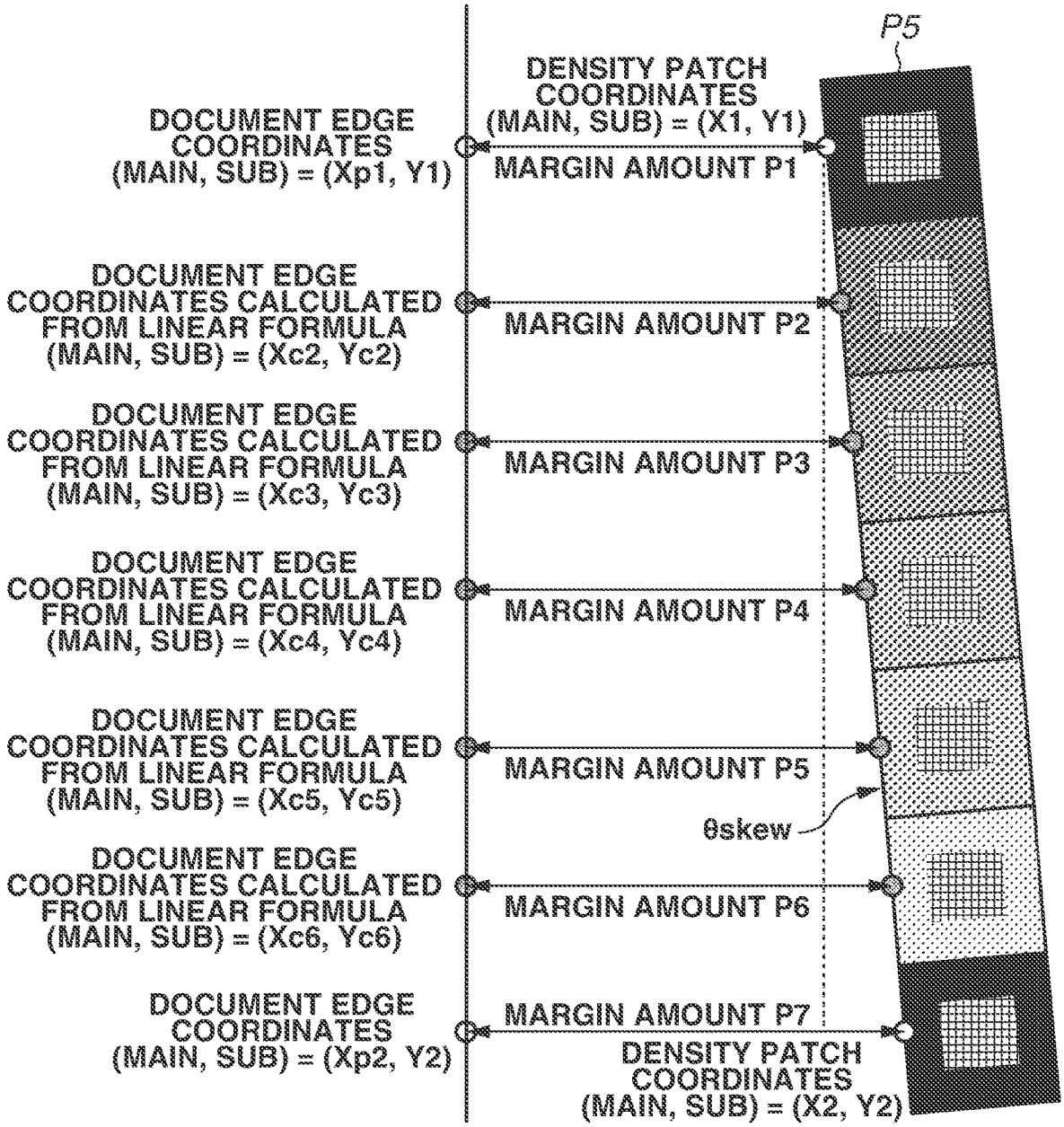
FIG. 9 is a diagram illustrating detection of a light shielding amount.

The left-edge coordinates storing region determination unit 305*b*1 determines the sub scanning range for storing the left-edge coordinates in the memory 305*b*3 based on the first left-edge coordinates, i.e., coordinates of an upper left edge of the density patch, output by the density patch left-edge coordinates detection unit 305*a*2, and the size of the density patch. The left-edge coordinates to be stored by the left-edge coordinates writing unit 305*b*2 are used to detect a skew amount of the density patch with respect to the line sensor units 312*a* and 312*b*. FIG. 9 illustrates skew amount detection. As illustrated in FIG. 9, left-edge coordinates of at least two different positions are used to detect the skew amount. As the left-edge coordinates of two different positions, the left-edge coordinates of the first and the last density patch portions having a high density are used since these density patch portions can be detected with a high detection accuracy. The regions for storing the left-edge coordinates are regions of two different sub scanning lines including one sub scanning line of the first density patch portion and one sub scanning line of the last density patch portion. Coordinates of the two different sub scanning lines in FIG. 9 are coordinates Y1 and Y2. The regions for storing the left-edge coordinates are not limited to the above-described regions but may be regions of a plurality of consecutive sub scanning lines. Obtaining average coordinates of left-edge coordinates of a plurality of consecutive sub scanning lines increases detection accuracy of the left-edge coordinates, and accordingly detection accuracy for a skew amount is also improved.

In the memory 305*b*3, the left-edge coordinates writing unit 305*b*2 writes the density patch left-edge coordinate values obtained from the density patch left-edge coordinates detection unit 305*a*2 in the sub scanning region determined by the left-edge coordinates storing region determination unit 305*b*1 and the document edge coordinate values obtained from the document edge detection unit 305*a*6.

The margin amount calculation unit 305*b*4 reads two different density patch left-edge coordinate values and the document edge coordinate values from the memory 305*b*3, and performs skew amount calculation and document edge linear formula calculation for the line sensor units 312*a* and 312*b* for the density patch on the recording material. A skew amount of the density patch is calculated based on two different coordinates: left-edge coordinates (X1, Y1) of one sub scanning line of the first density patch portion having a high density, and left-edge coordinates (X2, Y2) of one sub scanning line of the last density patch portion having a high density, as illustrated in FIG. 9. A skew amount θskew is calculated by the following Formula 1:

$$\theta skew=(Y1-Y2)/(X1-X2) \quad \text{(Formula 1).}$$

The document edge linear formula is calculated based on two different coordinates: document left-edge coordinates (Xp1, Y1) of one sub scanning line of the first patch portion having a high density, and document left-edge coordinates (Xp2, Y2) of one sub scanning line of the last density patch portion having a high density.

The document edge linear formula is calculated by the following Formula 2:

$$y-Y2=(Y1-Y2)/(Xp1-Xp2)*(X-Xp2) \quad \text{(Formula 2).}$$

Document edge coordinates and a margin amount for each density patch are illustrated in FIG. 9. The document edge coordinates corresponding to each of the density patches are calculated by using Formula 2. An X-coordinate is XcN and a Y-coordinate is YcN, where N denotes a patch number. The margin amount for each of the density patches is calculated based on the density patch coordinates detected by the density patch left-edge coordinates detection unit 305*a*2 and the document edge linear formula calculated by the margin amount calculation unit 305*b*4. The margin amount PN (N denotes the patch number) is calculated based on X-coordinates of each of the density patches and X-coordinates of the document edge.

The method for detecting the skew amount is not limited to the method for calculating the linear formula based on two different document edge coordinates. A method for measuring a distance from the document edge to the density patch is also applicable.

The luminance value reading unit 305*c* determines the range of the read data to be read, based on the skew amount of the density patch calculated by the skew amount detection unit 305*b*, and reads the read data from the memory 305*b*3 based on the determined range. The range to be read is a preset main scanning range plus the shift amount due to the skew amount.

For example, a predetermined range of a first region in the main scanning direction is XA to XB, a predetermined range of a second region in the main scanning direction is XC to XD, and a shift amount caused by the skew amount is a shift amount a. In this case, a range of the first region in the main scanning direction to be read is XA+a to XB+a, and a range of the second region in the main scanning direction to be read is XC+a to XD+a. Further, the shift amount a due to the skew amount is represented by a=b*(YC−Y1), where Y1 denotes the sub scanning coordinate of the left-edge coordinates, YC denotes the sub scanning coordinate of the density patch, and b denotes the skew amount detected in step S505. The reading of each region is performed on ranges shifted by the obtained shift amount.

The average luminance calculation unit 305*d* calculates an average luminance values for each density in the density patches based on respective pieces of the RGB image data read by the luminance value reading unit 305*c*. In a case where there are seven different patterns of the density patches as illustrated in FIG. 9, the average luminance calculation unit 305*d* calculates seven average values for each of R, G, and B, a total of 21 average luminance values. The average luminance calculation unit 305*d* corrects the average luminance values for each density of the density patches based on the margin amount calculated by the margin amount calculation unit 305*b*4. According to the calculated margin amount, the average luminance calculation unit 305*d* multiplies the average luminance values for each density of the density patches by an average luminance value correction rate to correct the average luminance values, and outputs the average luminance values as the final average luminance values for each density of the density patches. The correction rate is stored as a table based on the margin amount. An example of a correction table will be described below.

(Average Luminance Value Correction)

FIG. 10 illustrates a correction table for correcting the average luminance values for each density patch based on the margin amount calculated by the margin amount calculation unit 305*b*4.

An example of a predetermined margin amount is 2.5 mm, and an example of a variation of the margin amount is 0.1 mm. However, the margin amount and the variation are not limited to the above-described numerical values. The average luminance value correction rate increases with decreasing margin amount with respect to the predetermined margin amount, and the average luminance value correction rate decreases with increasing margin amount. However, the average luminance value correction rate illustrated in FIG. 10 is illustrative examples and is not limited thereto.

(Reflection Mechanism)

A mechanism of the reflection will be described below.

Figure 13:
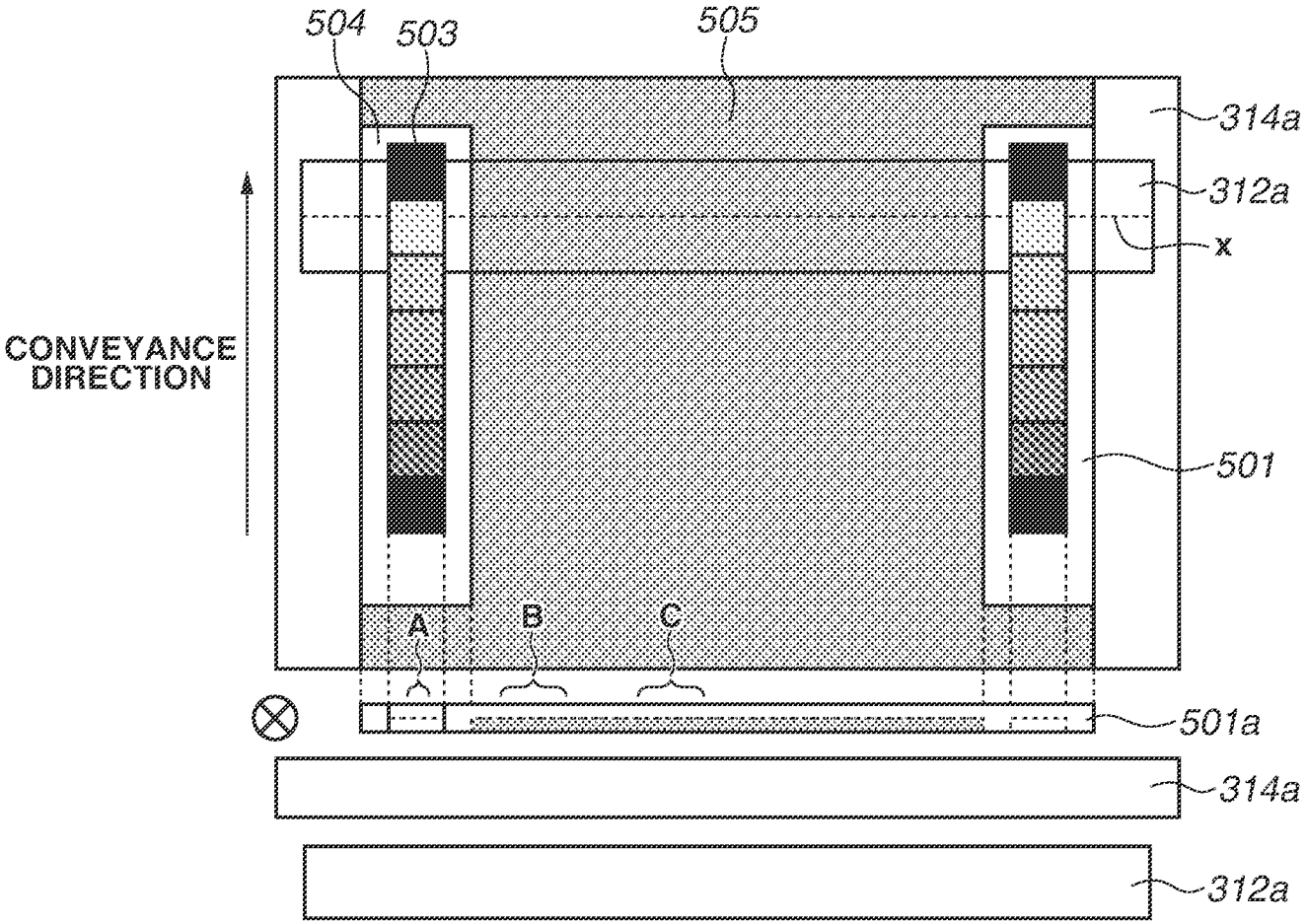
FIG. 13 is a diagram illustrating a state where the line sensor reads the density adjustment chart.

FIG. 13 illustrates an image layout with respect to the reading position. FIG. 13 includes a schematic view illustrating a density adjustment chart on a print product 501 viewed from the line sensor 301*a* and a cross-sectional view illustrating a print product 501*a*, a flow reading glass plate 314*a*, and the line sensor unit 312*a* taken along a broken line X in FIG. 13. The print product 501 includes a density patch 503, a white background region 504 around the density patch 503, and a user image region 505 where an any image (user image) can be printed. In the present exemplary embodiment, an image with a uniform density (halftone image) is printed in the user image region 505.

While, in the case of the print product 501, a halftone image with a uniform density is fully formed in the user image region 505, various images are actually printed by each job and in each page. A region A is included in the density patch 503. Regions B and C are included in the user image region 505. A distance from the region A to the region B is shorter than a distance from the region A to the region C.

The cross-sectional view in FIG. 13 illustrates a state where the print product 501 has reached a reading position X of the line sensor unit 312*a*. A halftone image is formed in the regions B and C. The flow reading glass plate 314*a* is a transparent member disposed between the recording material and the line sensor unit 312*a*. The line sensor unit 312*a* reads the density patches formed on the first surface of the recording material conveyed to the conveyance path 313 through the flow reading glass plate 314*a*. A different flow reading glass plate is disposed between the line sensor 312*b* and the recording material. The line sensor unit 312*b* reads the density patches formed on the second surface of the recording material conveyed to the conveyance path 313 through the different reading glass plate.

Figure 14:
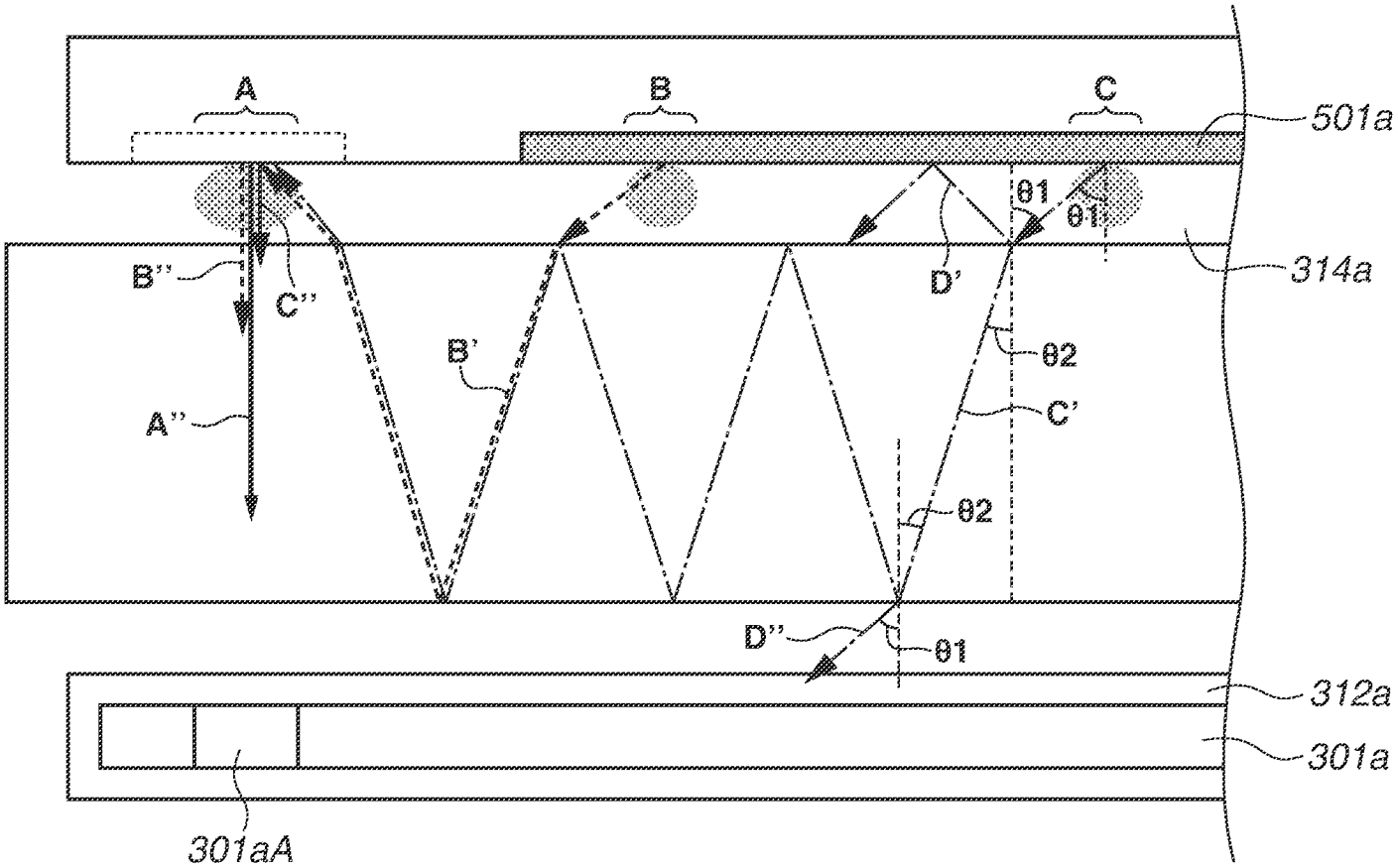
FIG. 14 is a schematic view illustrating reflected light from a reading target.

FIG. 14 illustrates the optical path of document reflected light. Document reflected light A" indicates reflected light that advances from the region A to a region 301*a*A on the line sensor unit 312*a*. Document reflected light B' and C' are light reflected in the flow reading glass plate 314*a* among document reflected light from the regions B and C, respectively. The refraction condition in the flow reading glass plate 314*a* is represented by the following Formula 3:

$$N1*\sin\theta1=N2*\sin\theta2 \quad \text{(Formula 3)},$$

where N1 denotes a refractive index of air, N2 denotes a refractive index of the flow reading glass plate 314*a*, θ1 denotes an angle of incidence from air to the glass, and θ2 denotes an angle of incidence from the glass to air.

Components totally reflected in the flow reading glass plate 314*a* increase with increasing angle θ1. This means that light having a larger angle than a certain angle, among document reflected light from the regions B and C, keeps intensity level high and more likely to be far-reaching. Document reflected light B" and C" indicate components of reflected light that advances toward the region 301*a*A of the line sensor unit 312*a* among the document reflected light B' and C' reflected in the flow reading glass plate 314*a*, respectively. The intensity of the document reflected light C' is attenuated to a further extent than the intensity of the document reflected light B' since the light C' is reflected in the flow reading glass plate 314*a* more times than the light B'. Accordingly, the intensity of the document reflected light B" from the region B is higher than the intensity of the document reflected light C" from the region C.

Meanwhile, the document reflected light from the region C incident on the flow reading glass plate 314*a* is partly reflected by the upper surface of the flow reading glass plate 314*a* and returns to the print product 501 as a reflected light D'. The light intensity of the reflected light D' is remarkably attenuated by the reflection on the upper surface of the flow reading glass plate 314*a*. Thus, a component that is reflected by the print product 501 again and then incident on the flow reading glass plate 314*a* again, and a component that is repetitively reflected between the print product 501 and the flow reading glass plate 314*a* and then reaches the region A are small enough to be ignored. There is also a component of the document reflected light C' (reflected light D") which transmits without being totally reflected by the bottom surface of the flow reading glass plate 314*a*. However, the line sensor unit 312*a* is designed to achieve focus of the sensor chip group 401*a* on the print product 501 through the lens array 403*a*, the reflected light D" is not formed on the line sensor 301*a*.

The above-described mechanism forms document reflected light A"+B"+C" in the region 301*a*A of the line sensor unit 312*a* where the document reflected light in the region A is formed. The light intensities of the document reflected light B" and C" change according to luminance of the image pattern in the user image region 505. For example, in a case where no user image is printed in the user image region 505 (i.e., in the case of a white background), the light intensities of the document reflected light B" and C" are maximized.

Accordingly, in the configuration discussed in United States Patent Application Publication No. 2012/0050771, an error occurs in a result of pattern image detection when a user image and a pattern image are formed.

Figure 15:
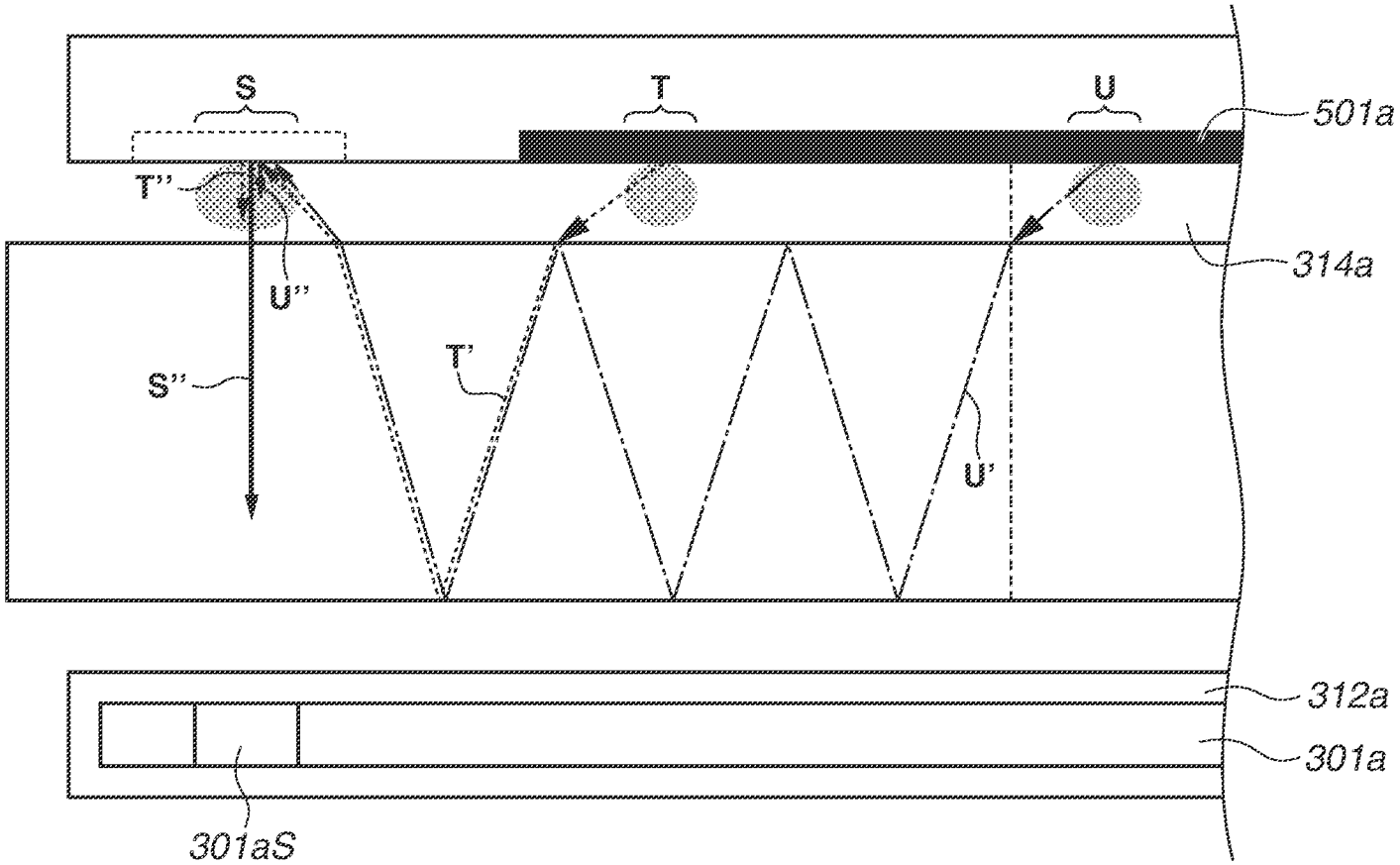
FIG. 15 is another schematic view illustrating reflected light from the reading target.

A case where a solid black image with a high density is printed in the user image region 505 will be described below with reference to FIG. 15. A region S is a region in the density patch 503, and regions T and U are regions in the user image region 505. A distance from the region S to the region T is shorter than a distance from the region S to the region U. The regions T and U are solid black regions. While the notations of the regions S, T, and U differ from the notations in FIG. 14 for convenience, the indicated regions are the same. Document reflected light T' and U' are light reflected in the flow reading glass plate 314*a* among reflected light from the region T and U, respectively. Document reflected light S" is document reflected light from the region S. Document reflected light T" and U" are components of the reflected light T' and U', respectively, reflected in the flow reading glass plate 314*a*. These components travel toward a region 301*a*S of the line sensor unit 312*a*. In the region 301*a*S of the line sensor unit 312*a* where the document reflected light of the region S is formed, document reflected light S"+T"+U" are formed. The document reflection intensity decreases with increasing density of the image in the user image region 505. Thus, the intensity of the document reflected light T" is smaller than the intensity of the document reflected light B", and the intensity of the document reflected light U" is smaller than the intensity of the document reflected light C". When the density of the image increases and an image having the highest density printable by the printer 150 is printed in the user image region 505, the intensity of the document reflected light T" is much smaller than the intensity of the document reflected light B", and the intensity of the document reflected light U" is much smaller than the intensity of the document reflected light C". Consequently, the document reflected light S"(=A") is formed in the region 301*a*S of the line sensor unit 312*a*. This means that the document reflected light formed in the region 301*a*S of the line sensor unit 312*a* is not affected by the reflection from the user image region 505.

A reading luminance value of the region A (S) is maximized in a case where no user image is printed in the user image region 505. A luminance value in this case is equivalent to a luminance value when the document reflected light A", B", and C" are received. On the other hand, a reading luminance value of the region A is minimized when the user image region 505 is printed in black having the highest density. A luminance value in this case is equivalent to a luminance value when the document reflected light A"(=S") is received. A total reflection amount τ from the user image region 505 is defined by the following Formula 4. The total reflection amount τ can also be referred to as a ratio of a light incident to the region subjected to the reception of the reflected light from the region A to the light totally reflected by the transmission member from regions other than the density patches with respect to the reflected light from the region A through which the density patches pass.

$$T=((A''+B''+C'')-A'')/A''=(B''+C'')/A'' \quad \text{(Formula 4)}$$

The total reflection amount τ is a constant pre-acquired in an experiment. For example, the CPU 114 acquires read data RD1 (=A"+B"+C") of the region 301*a*A of the line sensor unit 312*a*. The read data RD1 is obtained when the line sensor unit 312*a* reads a print product in which no image is formed in the regions A and D. The CPU 114 further acquires read data RD2 (=A") of the region 301*a*A of the line sensor unit 312*a*. The read data RD2 is obtained when the line sensor unit 312*a* reads a print product in which no image is formed in the region A and a black image with the maximum density is formed in the region D. The total reflection amount τ may be determined based on the read data RD1 and RD2 by using Formula 4. The total reflection amount τ is stored, for example, in the HDD 115.

Figure 16:
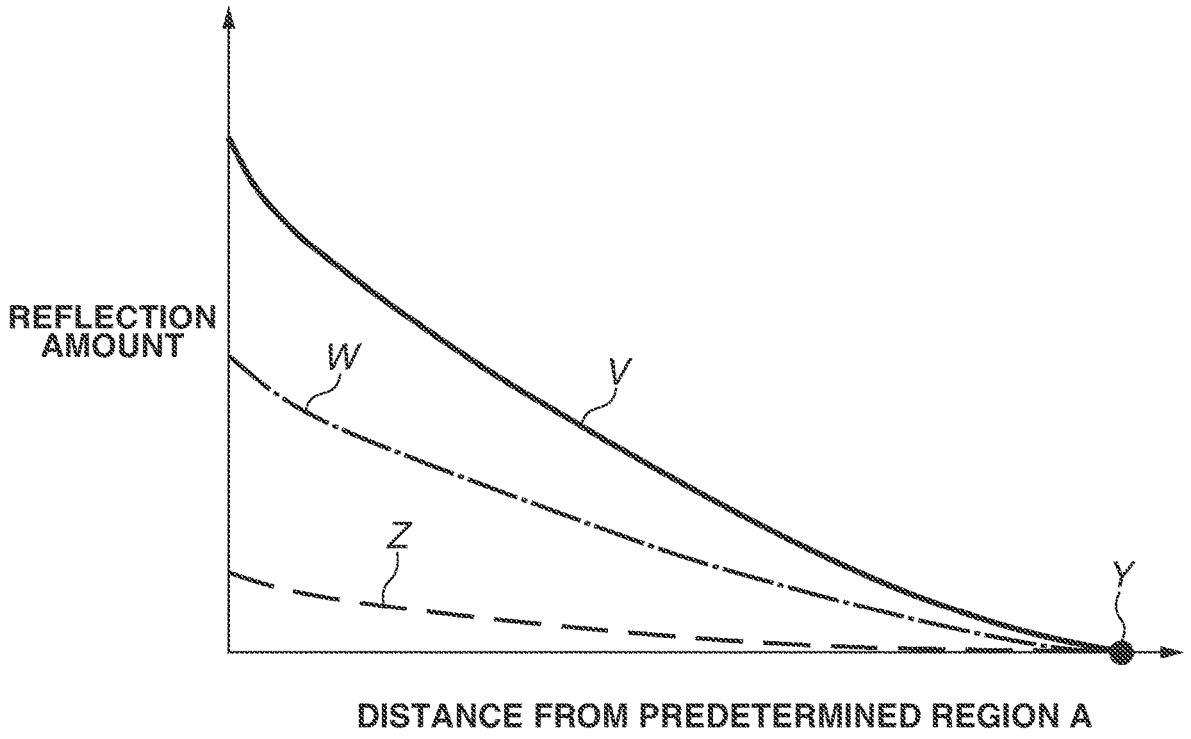
FIG. 16 is a chart illustrating distance characteristics of reflection.

FIG. 16 is a chart illustrating distance characteristics of the reflection. A horizontal axis is assigned a distance from the target region to the region A in the user image region 505, and a vertical axis is assigned a reflection amount. A solid line V indicates distance characteristics in a case where the user image region 505 is the background of paper, a chain line W indicates distance characteristics in a case where the user image region 505 is a halftone, and a dotted line Z indicates the distance characteristics in a case where the user image region 505 is black having the highest density. The reflection amount increases with decreasing distance to the region A or decreasing density. On the contrary, the reflection amount decreases with increasing distance to the region A. When the distance to the region A becomes Y, the reflection amount becomes 0. It is possible to quantify the reflection by normalizing the reflection amount from the user image region 505 by using the reflection amount in a case where the user image region 505 is black having the highest density, and the reflection amount in a case where the user image region 505 is paper white.

(Quantification of Reflection)

Figure 11:
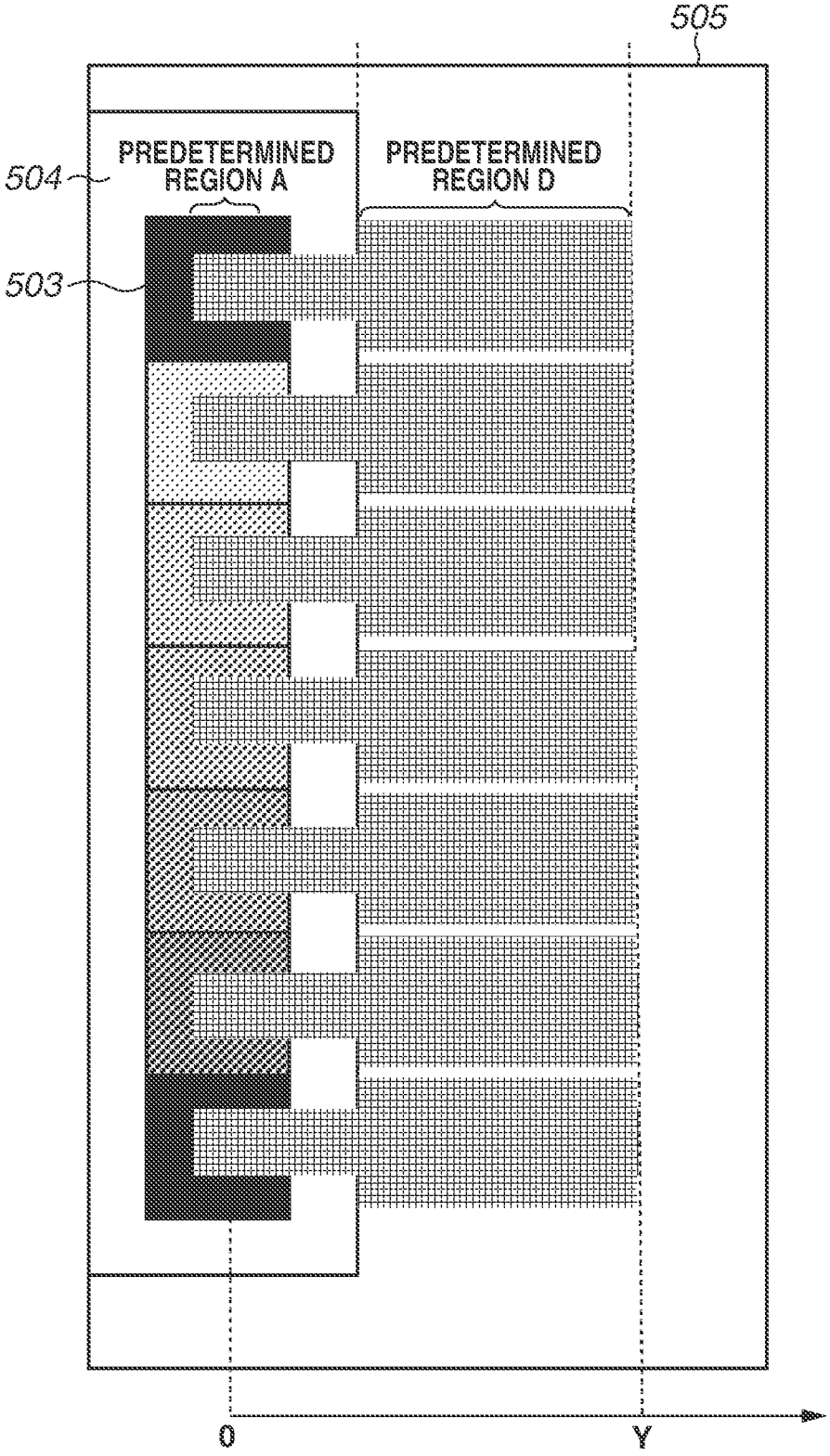
FIG. 11 is a diagram illustrating read data stored in a memory.

FIG. 11 illustrates read data stored in the memory 305*a*5. Referring to FIG. 11, the read data of the shaded regions is stored in the memory 305*a*5. The region D, which is a part of a region in the user image region 505, includes up to the position Y where the reflection affects the region A. A part of the white background region 504 around the density patches is included between the regions A and D. Read data for this part of the white background region 504 is also stored in the memory 305*a*5.

Figure 12:
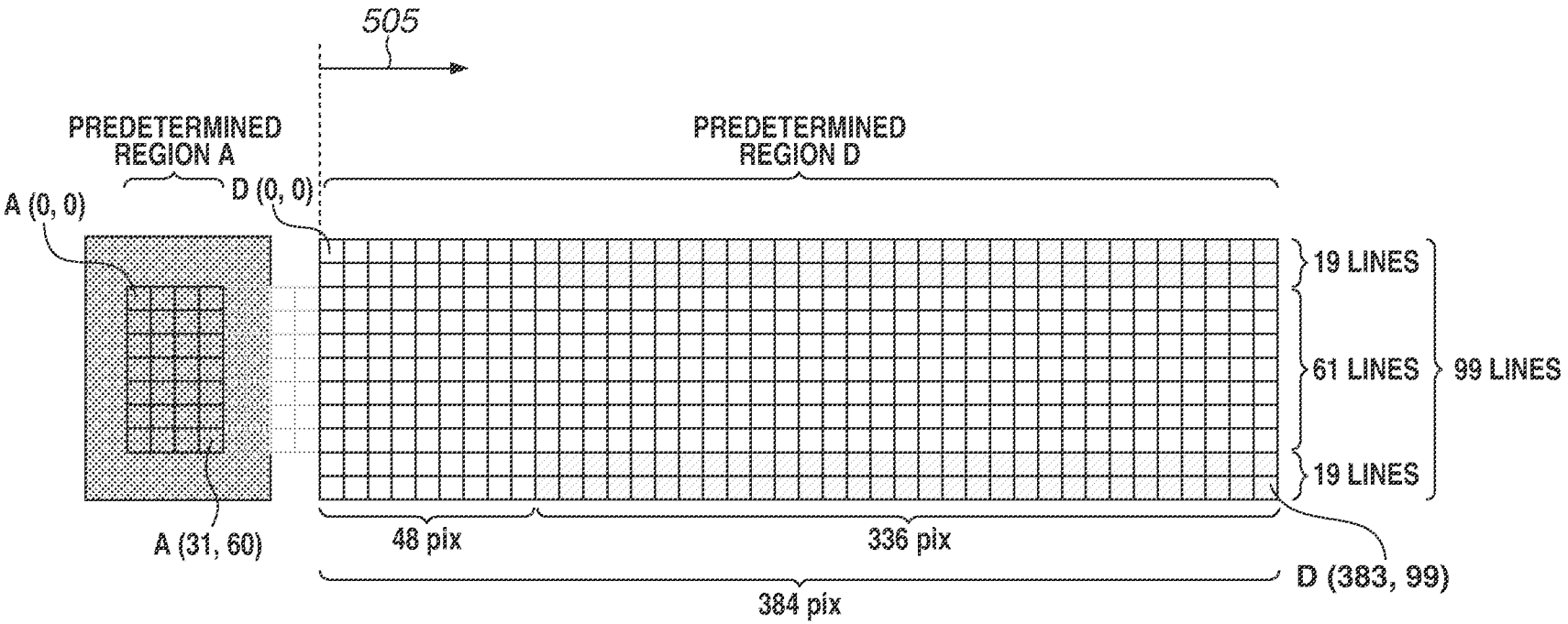
FIG. 12 is a schematic view illustrating a region read by pixels of the line sensor.

A region for one patch portion in FIG. 11 will be described in detail below with reference to FIG. 12. The region A includes 32 pixels in the main scanning direction and 61 lines in the sub scanning direction. The region D includes 384 pixels in the main scanning direction and 100 lines in the sub scanning direction. Coordinates of each pixel in the regions A and D are represented by A(x, y) and D(x, y), and data of each pixel is defined as Ai and Dj, respectively. i and j denote integers that start from the upper left position and increment from left to right in FIG. 12. For example, A1 indicates the first read data of the region A, i.e., the read data of coordinates A(0, 0). A33 indicates the read data of coordinates A(0, 1), and A1952 indicates the read data of coordinates A(31, 60). This also applied to the region D, where i=1 to 1952, and j=1 to 38016. A position of a certain pixel that outputs data Ai corresponds to a position within the range where the density patch passes through in the main scanning direction. The position of another pixel that outputs data Dj corresponds to a position outside the range where the density patch passes through in the main scanning direction.

The region D is vertically wider in the sub scanning direction than the region A. This is because it is known that a read value of a target density patch is affected by the reflection from the periphery of the density patch on an experimental basis. More specifically, in portions in the region A close to the region D, a read value is also affected by the reflection from an oblique direction. Therefore, the width of the region D in the sub scanning direction is larger than the width of the region A in the sub scanning direction.

In particular, ranges from the 1st to the 48th pixels from the left and upper and lower 19 lines in the sub scanning direction in the region D largely affect the reflection to the region A.

On the other hand, ranges from the 49th to the 383rd pixels from the left and upper and lower 19 lines in the sub scanning direction (the gray portion in FIG. 12) affect the reflection to the region A to a relatively small extent. Thus, pixel values in this region (the gray portion in FIG. 12) are processed by using a small coefficient to prevent overcorrection in a correction algorithm (described below) or to take measures not to affect the correction effect by using coefficient 0. Alternatively, the pixel values in this region (the gray portion in FIG. 12) are not used for the correction calculation.

The CPU 114 controls the luminance value reading unit 305*c* to read an image region and process the stored read data to quantify the reflection.

The calculation applied to the read data in the region A by the CPU 114 will be described below. For the region A, the CPU 114 reads all pixels and calculates an average luminance value I (Aave) as a target data in subsequent reflection correction.

The calculation applied to the read data in the region D by the CPU 114 will be described below. For the read data in the region D, the CPU 114 sequentially reads pixels one by one, multiplies the read pixel value by a preset coefficient for a corresponding pixel (described below), and adds all of the multiplication results.

FIG. 17 illustrates examples of coefficients for pixels. The coefficients are predetermined for pixels, respectively. The coefficient for each pixel is defined as Kj. For example, K1 indicates the first coefficient of the first region D, i.e., the coefficient for the read data of coordinates D(0, 0). K385 indicates the coefficient of coordinates D(0, 1), and K38016 indicates the coefficient of coordinates D(383, 99). The coefficient Kj is generated based on the distance characteristics illustrated in FIG. 16. The coefficient of coordinates D(0, 50) having the shortest distance from the region A is the largest. The coefficient decreases with increasing distance from the region A.

As described above, the region D close to the region A is affected by the reflection from an oblique direction. Thus, the coefficient Kj of coordinates D(0, 0) is larger than the coefficient Kj of coordinates D(0, 383) to correct the influence of the reflection.

The influence of the reflection from an oblique direction decreases with increasing distance in the main scanning direction. Thus, a value of the coefficient Kj also decreases with increasing distance from the region A in the oblique direction. To prevent the above-described overcorrection, the coefficient Kj in the range from coordinates D(0, 48) to coordinates D(19, 383) is set to 0. Accordingly, in a region close to the region A, these coefficients suitably correct the influence of the reflection from an oblique direction, and prevent the accuracy degradation due to overcorrection by not using pixel values in regions distant in the main scanning direction where the influence of the reflection is very small. A coefficient K19201 of coordinates D(0, 50) is 1.000, and a coefficient K384 of coordinates D(0, 383) is 0.

The CPU 114 performs a multiplication Dj*Kj and add the result for each pixel. The addition value P is calculated by CPU 114, as represented by the following Formula 5:

$$P = \sum_{j=1}^{38016} (Dj \times Kj). \quad \text{(Formula 5)}$$

In a case where the region D is a white background and the luminance value is 255 for all pixels (the maximum luminance value is 255), a maximum value Pmax of the addition value P is 3409005 (rounded off at the first decimal place). In a case where the region D is black and the luminance value is 10 for all pixels (the maximum luminance value is 255), a minimum value Pmin of the addition value P is 133686 (rounded off at the first decimal place). Pmax and Pmin are fixed values. An addition value Pu for an arbitrary user image is one of numeric values from 133686 to 3409005. For example, when the luminance value is 128 (/255) for all pixels, an addition value in a case where the read data of the region D is a solid halftone is 1711187 (rounded off at the first decimal place).

(Calculating Correction Rate of Reflection)

The CPU 114 associates the addition value P with the total reflection amount t and calculates a reflection correction rate Q by using the following Formula 6:

$$Q=1/(\tau*((Pu-P\text{min})/(P\text{max}-P\text{min}))+1 \quad \text{(Formula 6)}$$

The reflection correction rate Q is the multiplier applied to the average luminance value I (Aave) of the region A as the above-described correction target. More specifically, the reflection correction rate Q is minimized (Qmin=0.954) when Pu=Pmax, and is maximized (Qmax=1.000) when Pu=Pmin. When Pu=Pmax, the region A is in a state of being affected by the reflection to the maximum extent. Thus, the reflection correction rate Q is a scalar quantity which means that the average luminance value I (Aave) of the region A is corrected to a lower value by being multiplied by Qmin=0.954. On the other hand, when Pu=Pmin, the region A is not affected by the reflection from the user image. Thus, the reflection correction rate Q is a scalar quantity which means that the average luminance value I (Aave) of the region A is not corrected by being multiplied by Qmax=1.000. When Pu=Puht, Qu becomes 0.978, and the region A is subjected to the moderate reflection from the user image. Thus, the reflection correction rate Q is a scalar quantity which means that the average luminance value I (Aave) of the region A is suitably corrected to a lower value.

(Correction of Reflection)

As described above, the average luminance value I (A'''ave) of the region A after the implementation of the reflection correction is calculated by the following Formula 7:

$$I(A'''\text{ave})=Q*I(A\text{ave}) \quad \text{(Formula 7)},$$

where I (A'''ave) denotes an average luminance value of the region A after the reflection correction.

More specifically, if the average luminance value I (Aave) of the region A in a case where the region D is a white background is 210 (/255), the average luminance value A''' of the region A after the reflection correction is 200. This is equivalent to the luminance value of when the document reflected light A" is received in the region 301*a*A of the line sensor unit 312*a*. Accordingly, the reflection of the document reflected light B" and C" can be accurately detected and corrected.

(Flowchart of Reflection Correction)

Figure 18:
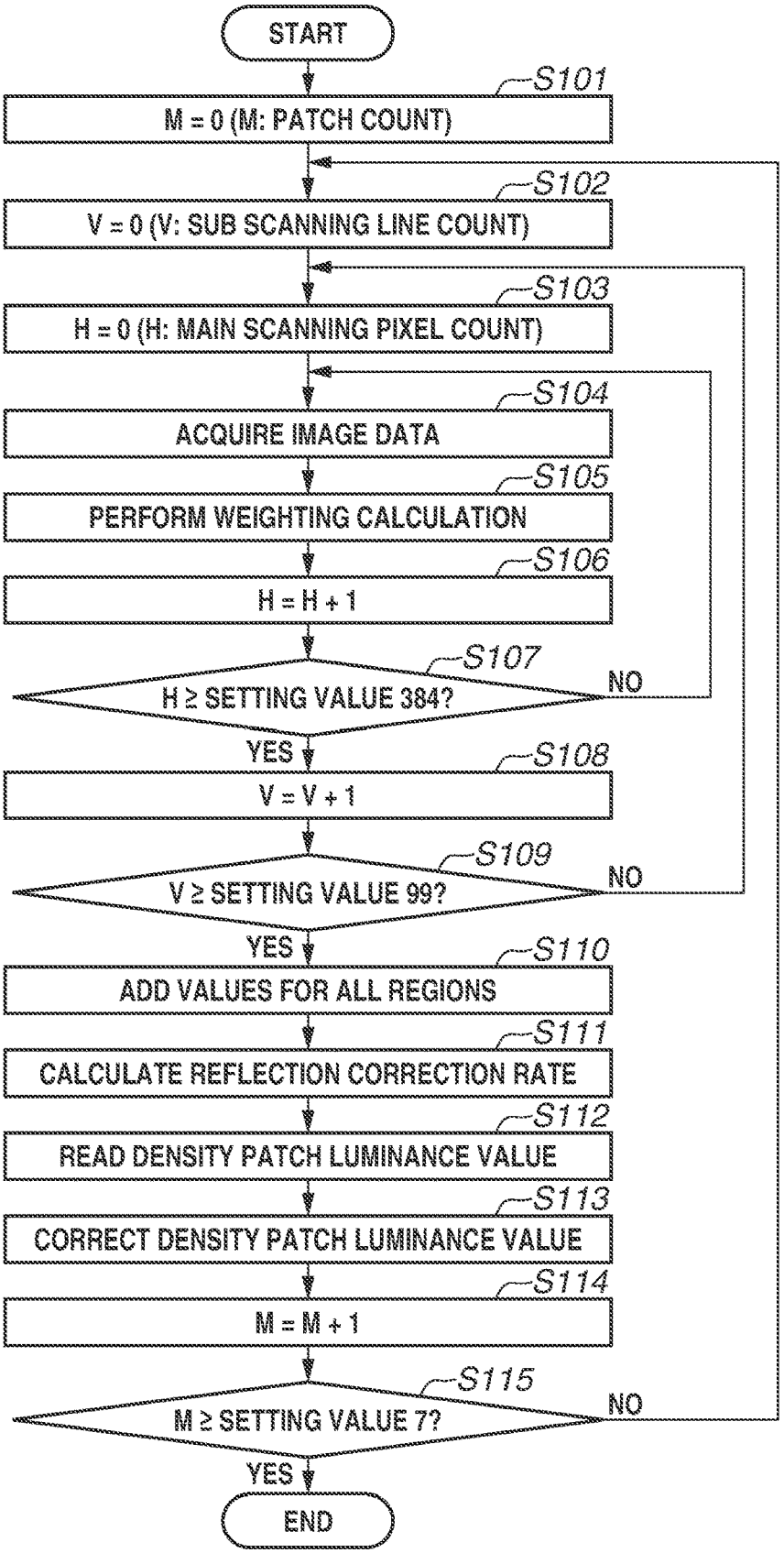
FIG. 18 is a flowchart illustrating a subsequence of density detection processing.

Lastly, the processing procedure of density detection processing in step S506 performed by the CPU 114 will be described in detail below with reference to FIG. 18.

In step S101, the CPU 114 initializes a density patch count to 0. The density patch count is used to grasp the number of density patches on one sheet of the recording material. When the density patch count reaches the number of density patches on one sheet of the recording material, the detection processing is completed.

In step S102, the CPU 114 initializes a sub scanning line count to 0. In step S103, the CPU 114 initializes a main scanning pixel count to 0. In step S104, the CPU 114 accesses the luminance value reading unit 305*c* to read the luminance value Dj. In step S105, the CPU 114 multiplies the luminance value Dj read in step S104 by the coefficient Kj prepared for each pixel and stores the multiplication result. In step S106, the CPU 114 increments the main scanning pixel count by one. In a case where the main scanning pixel count is equal to or larger than 384 (YES in step S107), the processing proceeds to step S108. On the other hand, in a case where the main scanning pixel count is smaller than 384 (NO in step S107), the processing returns to step S104.

In step S108, the CPU 114 increments the sub scanning line count by one. In a case where the sub scanning line count is equal to or larger than 99 (YES in step S109), the processing proceeds to step S110. On the other hand, in a case where the sub scanning line count is smaller than 99 (NO in step S109), the processing returns to step S103.

In step S110, the CPU 114 adds all of the values stored in step S105 to calculate the addition value P. In step S111, the CPU 114 acquires the reflection correction rate Q by using the addition value P obtained in step S110. In step S112, the CPU 114 accesses the luminance value reading unit 305*c* to calculate the average luminance value I (Aave) of the region A. In step S113, the CPU 114 multiplies the reflection correction rate Q obtained in step S111 by the average luminance value I (Aave) of the region A obtained in step S112. In step S114, the CPU 114 increments the density patch count by one. In step S115, in a case where the density patch count is equal to or larger than 7 (YES in step S115), the processing exits the flowchart and proceeds to step S507. On the other hand, in a case where the density patch count is smaller than 7 (NO in step S115), the processing returns to step S102. The CPU 114 performs the above-described processing for each patch disposed in the chart.

By above-described processing, the influence of the reflection from the user image in the vicinity of the density patches can be accurately detected, and correction can be performed to obtain luminance values free from the influence of the reflection.

A second exemplary embodiment of the disclosure will be described below. For elements duplicated with the ones of the first exemplary embodiment, redundant descriptions will be omitted.

The image forming apparatus 100 (the reading apparatus 160) according to the first exemplary embodiment sets the entire region D having a wider vertical width in sub scanning direction than the vertical width of the region A. This configuration is to correct the influence of the reflection from an oblique direction with respect to the density patches and prevent overcorrection.

However, in a region distant from the region A where the value of Kj is 0, the calculation is simply the multiplication by 0. Thus, for example, if the CPU 114 neither stores the pixel values of the region in the memory nor performs the multiplication, the memory area to be used can be saved. In such a case, since unnecessary multiplication is not performed, a processing apparatus can be simplified to a further extent.

An example of devising a region setting method for the region D, reducing the influence of the reflection from an oblique direction, and preventing overcorrection will be described below.

For the regions where the coefficient according to the first exemplary embodiment is set to 0, a memory is not secured. Further, secured memories and coefficient arrays for a rectangular form according to the first exemplary embodiment are modified to conform to a shape illustrated in FIG. 19. In this example in comparison with the first exemplary embodiment, black portions in the region D are not secured as memories, and data Dj and coefficients Kj are defined for each pixel as follows.

For example, K1 indicates the first coefficient of the region D, i.e., the coefficient for the read data of coordinates D(0, 0). K48 indicates coordinates D(47, 0).

Figure 19:
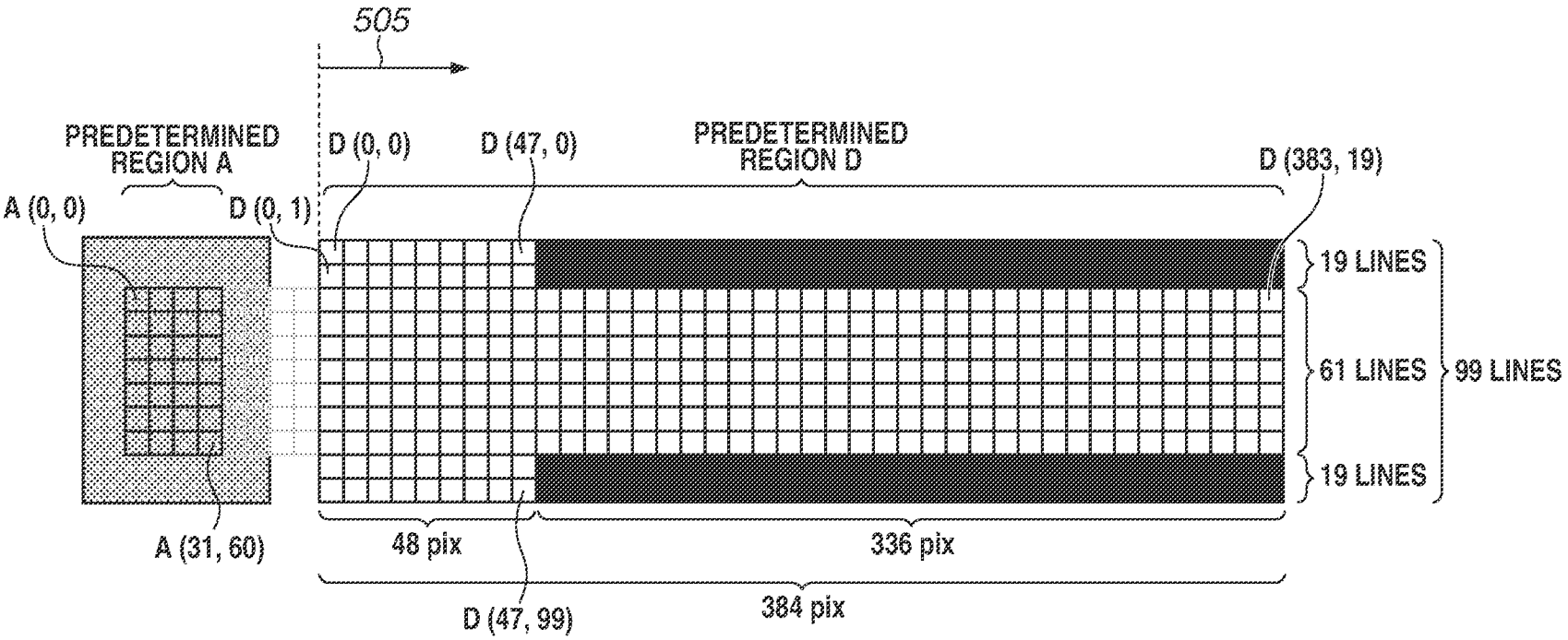
FIG. 19 is a diagram illustrating a region stored in the memory.

For black portions, neither memories nor coefficients Kj are prepared. Thus, K49 is prepared to conform to coordinates D(0, 1). As illustrated in FIG. 19, by preparing neither memories nor coefficients for portions not affected by the reflection, and setting memories and coefficients only for necessary positions in this way, the amounts of memory and calculation can be reduced.

Figure 20:
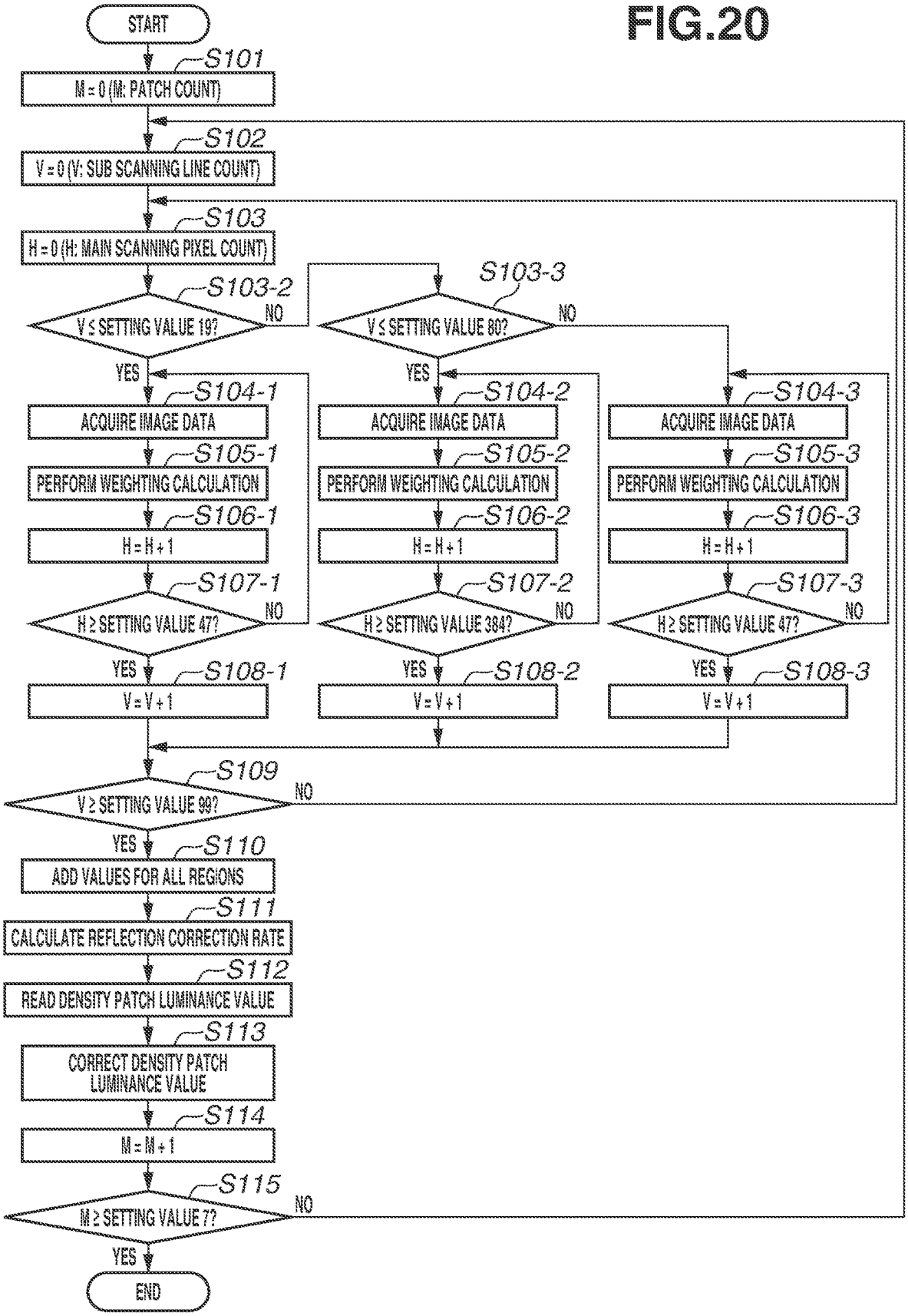
FIG. 20 is a flowchart illustrating another subsequence of the density detection processing.

The above-described operation will be described below with reference to the flowchart in FIG. 20. For elements duplicated with the ones of the first exemplary embodiment, redundant descriptions will be omitted.

The image forming apparatus 100 (reading apparatus 160) does not store black portions in memory as described above. Thus, a read operation and a line count operation in reading an image are different from the read operation and the line count operation according to the first exemplary embodiment.

In steps S103-2 and S103-3, the CPU 114 determines a position of the current line from which the current sub scanning line is being read. In a case where the current line is included in the first 19 lines (YES in step S103-2), the processing proceeds to step S104-1. In a case where the current line is included in the middle 61 lines (YES in step S103-3), the processing proceeds to step S104-2. In a case where the current line is included in the last 19 lines (NO in step S103-3), the processing proceeds to step S104-3.

In the operations from step S104-1 to step S107-1, the CPU 114 acquires data for 48 pixels in the main scanning direction and performs a weighting calculation.

In the operations from step S104-2 to step S107-2, the CPU 114 acquires data for 384 pixels in the main scanning direction and performs a weighting calculation.

In the operations from step S104-3 to step S107-3, the CPU 114 acquires data for 48 pixels in the main scanning direction and performs a weighting calculation.

While, in the second exemplary embodiment, memories are arranged in the form illustrated in FIG. 19, a similar effect can be obtained in any memory form as long as the memory form conforms to the concept that neither memories nor coefficients are prepared for regions affected by the reflection to a small extent. For example, referring to FIG. 19, the black regions may gradually extend in the sub scanning direction as the black regions shift to the right in the main scanning direction.

In the present exemplary embodiment, similar calculations to those according to the first exemplary embodiment can be performed, whereby unnecessary calculations (multiplication by 0) can be omitted and the memory capacity in comparison with the first exemplary embodiment can be saved.

Another method according to a third exemplary embodiment for quantifying the reflection will be described in detail below. This method includes four different processes including steps S1 to S4.

(Step 1: Acquiring Luminance Value)

Figure 21:
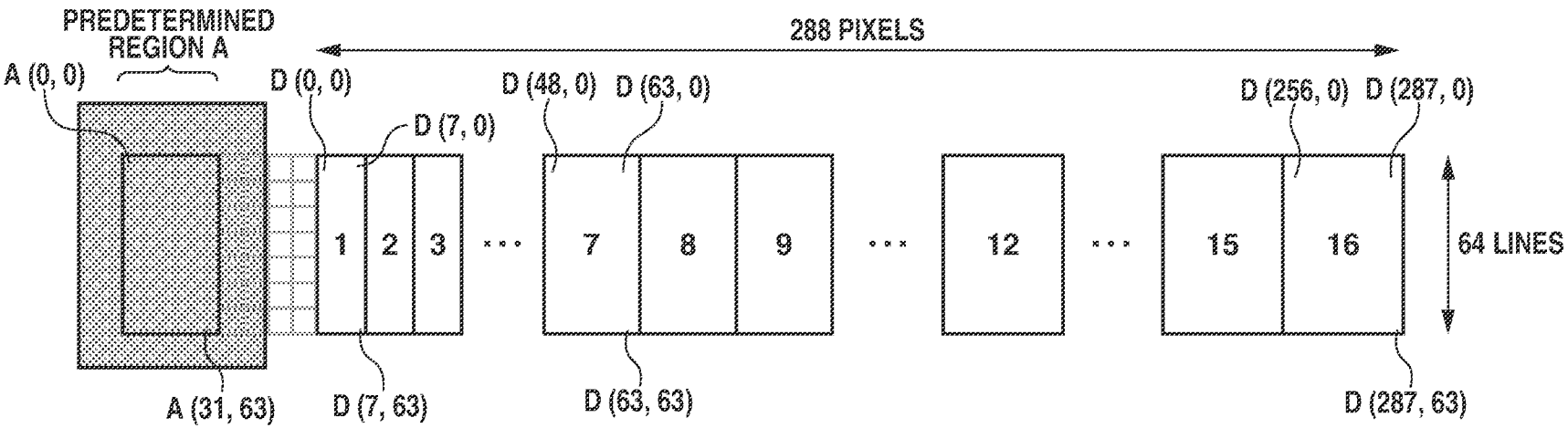
FIG. 21 is a diagram illustrating a state where data is read from pixels of the line sensor.

FIG. 21 illustrates read data that is read from the memory 305*a*5 by the luminance value reading unit 305*c* and then processed. The region A includes 32 pixels in the main scanning direction and 64 lines in the sub scanning direction. The region D includes 288 pixels in the main scanning direction and 64 lines in the sub scanning direction. The luminance values of pixels in the regions A and D are represented by A(x, y) and D(x, y), respectively, where x denotes the pixel position in the main scanning direction and y denotes the line position in the sub scanning direction.

The CPU 114 controls the luminance value reading unit 305*c* and the average luminance calculation unit 305*d* to perform a calculation on the read data of the region A. The calculation will be described below. The CPU 114 controls the luminance value reading unit 305*c* to read all pixels of the region A, and reads the average luminance value calculation result I (Aave) by the average luminance calculation unit 305*d*. This data is subjected to the subsequent reflection correction.

The CPU 114 controls the luminance value reading unit 305*c* and the average luminance calculation unit 305*d* to perform a calculation on the read data of the region D. The calculation will be described below. Firstly, the CPU 114 controls the luminance value reading unit 305*c* to read the read data of a region from D(0, 0) to D(7, 63) corresponding to a division region 1 and then read the average luminance value calculation result by the average luminance calculation unit 305*d*. Processing to the average luminance value calculation result will be described below. Then, the CPU 114 reads the average luminance value calculation result of a region corresponding to a division region 2 and processes the result in a similar way. Then, the CPU 114 sequentially repeats similar processing for each of predetermined division regions. As described above, the influence of the reflection decreases with increasing distance from the region A. Thus, in consideration of reflection correction accuracy and optimization of the reading circuit scale, the width of each division region is increased with increasing distance from the region A. More specifically, the CPU 114 sets a pixel width of 16 in the main scanning direction from a division region 7, and sets a pixel width of 32 in the main scanning direction from a division region 12. The pixel width of the region D and the width of each division region are not limited those according to the present exemplary embodiment. For example, the width may be the same for all division regions.

(Step 2: Luminance-to-Density Conversion)

Figure 22:
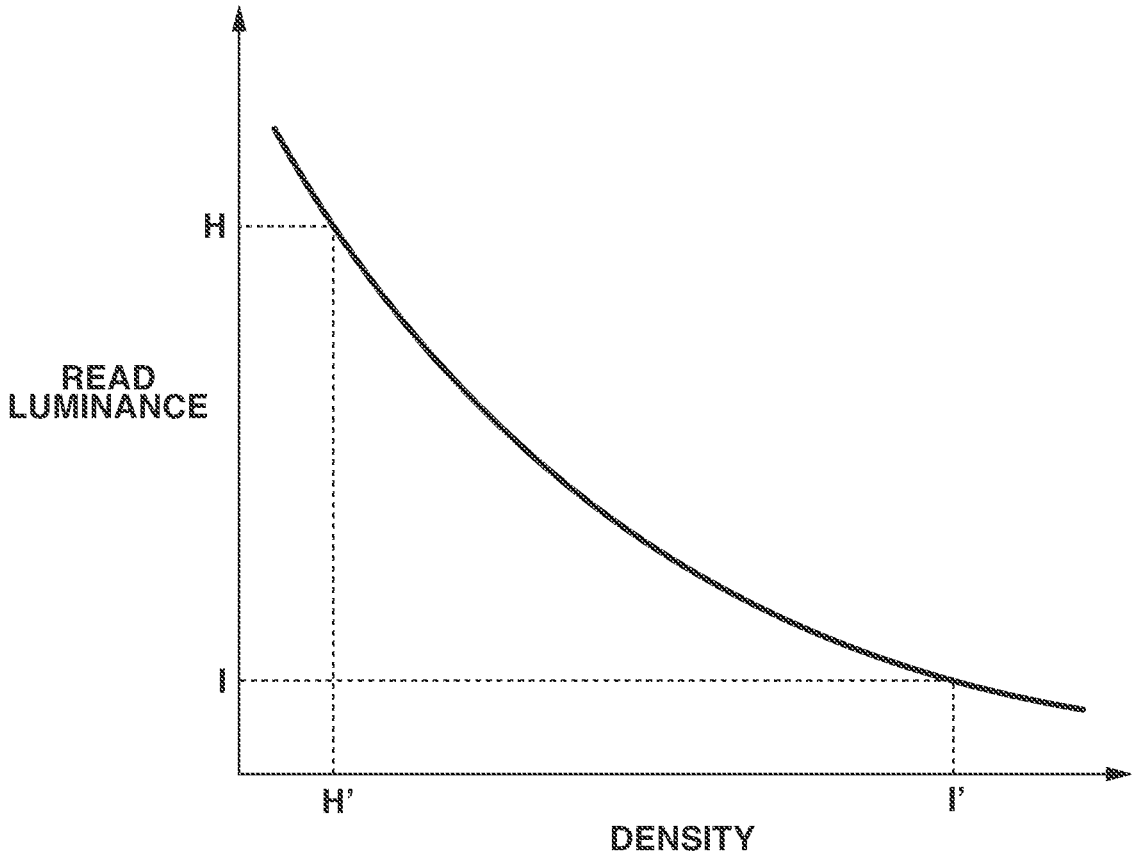
FIG. 22 is a chart illustrating luminance vs density characteristics.

FIG. 22 illustrates a luminance-density characteristic. The horizontal axis is assigned the density as a result of reading a predetermined density patch by using a colorimeter, such as Xlite, and the vertical axis is assigned the read luminance as a result of reading the same density patch by using line sensors corresponding to complementary colors of the line sensor units 312*a* and 312*b*. FIG. 22 illustrates an example of a characteristic between a density of a magenta patch and a luminance value read by G line sensors of the line sensor units 312*a* and 312*b*. Actually, characteristics for respective patch colors (Y, M, C, and K) are provided and a characteristic corresponding to a patch color subjected to the density correction is selected from among the characteristics. For example, in a case where the patch color C is subjected to the density correction, a C-R luminance-density characteristic is used. In a case where the patch color M is subjected to the density correction, an M-G luminance-density characteristics is used. In a case where the patch color Y is subjected to the density correction, a Y-B luminance-density characteristic is used. In a case where the patch color K is subjected to the density correction, a K-G luminance-density characteristics is used. Each of the characteristics associate a colorimeter density of a corresponding density patch with a reading luminance of the same density patch, and are known characteristics stored in the ROM 112 as a product program based on development-time data. Actually, each of the characteristics is stored as a table. The CPU 114 converts an input read luminance into a corresponding colorimeter acquired density. The above-described average luminance value calculation result by the average luminance calculation unit 305*d* is once converted into a density to use the colorimeter criterion as the criterion of the reflection correction. For example, an average luminance value calculation result H is converted into a density H'. An average luminance value calculation result I (<H) is converted into a density I' (>H').

(Step 3: Density to Luminance Reduction Rate Conversion)

The next step for processing for converting the converted density into a luminance reduction rate will be described below. The luminance reduction rate is a scalar quantity that refers to "a degree by which read luminance of a target region is reduced based on a peripheral image density".

Figure 23A:
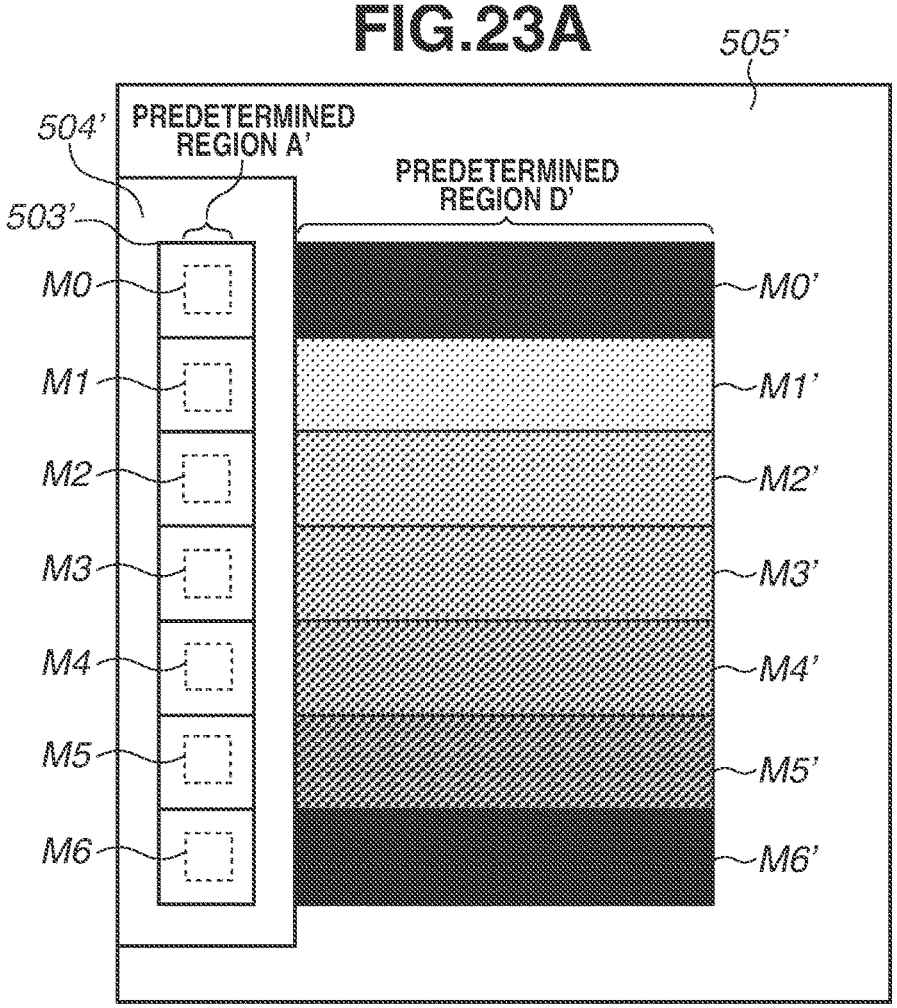
FIG. 23A is a schematic view illustrating a test chart for determining a luminance reduction rate.

FIG. 23A is an example of a test chart for generating a characteristic for determining a luminance reduction rate. The test chart includes a density patch 503' including seven patch portions which are all paper white. The density patch includes patch portions M0 to M6 from the top downward. The test chart also includes a white background region 504' around the patch portions. A region 505' corresponds to a user image, a region A' indicates a region in the density patch, and a region D' indicates a region in the user image. The positional relation between the density patch 503', the white background region 504', and the region A' is the same as that between the density patch 503, the white background region 504, and the region A. The region D' includes solid patterns having different densities for each patch portion. The region D' include patterns M0' to M6' from the top downward. Since the pattern M1' is paper white, the pattern M1' has the same density as the patch portion M1. To correctly determine the luminance reduction rate, in one embodiment, the pattern M6' is printed with the highest density out of densities that can be output by the image forming apparatus 100. The patterns M2' to M5' are not limited to four gradations. In one embodiment, as many gradations as possible from among densities between the patterns M1' and M6' are printed. The densities of the patterns M0' to M6' are measured beforehand by using a colorimeter, such as Xlite. A width of the region D' is set to a width more than or equal to a range which is subjected to the influence of the reflection or larger, i.e., 288 pixels according to the present exemplary embodiment.

In the development stage, the CPU 114 acquires the luminance reduction rate for each patch portion based on the luminance values as a result of reading the test chart, by using the following Formula 8:

$$\text{Luminance reduction rate} = \text{Luminance value of } Mn / \text{Luminance value of } M1 \quad \text{(Formula 8)},$$

where n is an integer from 2 to 6, and the luminance reduction rate of the patch portion M1 is fixed to 1.000.

More specifically, when M1=210 (/255) and the luminance value of the patch portion M2 is 207, the luminance reduction rate is 0.986 (rounded off to the third decimal place). When the luminance value of the patch portion M6 is 200, the luminance reduction rate is 0.952 (rounded off to the third decimal place).

Figure 23B:
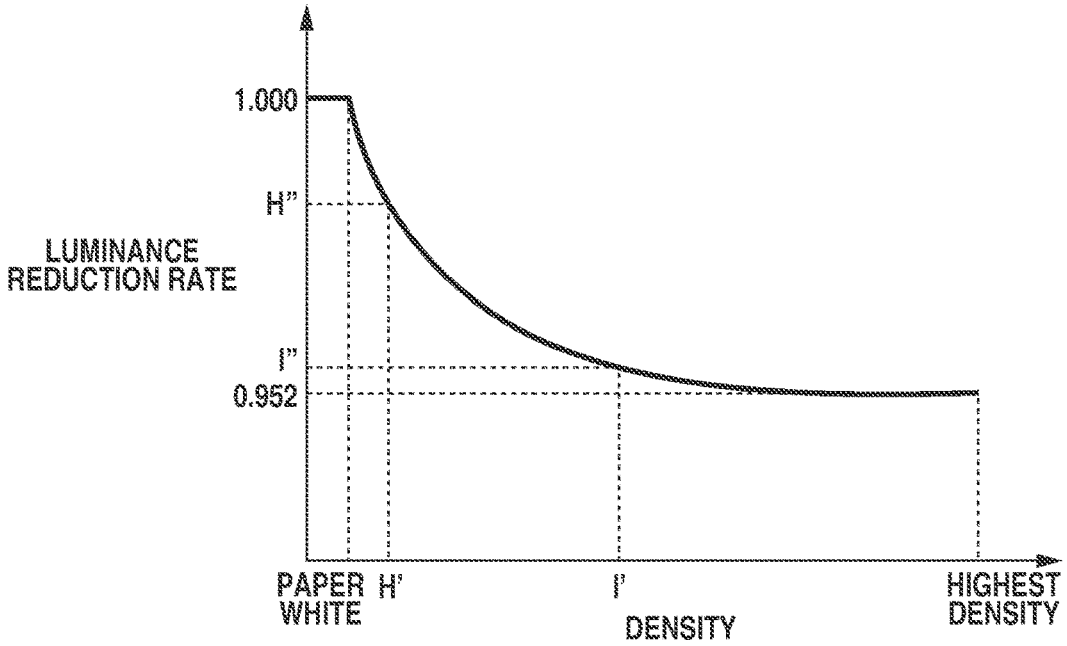
FIG. 23B is a chart illustrating the luminance reduction rate.

FIG. 23B is a chart illustrating a density-luminance reduction rate characteristic. As described above, this chart is generated by plotting a colorimeter density and a luminance reduction rate for the patterns M0' to M6' obtained as described above. The horizontal axis is assigned the colorimeter density of the patterns M1' to M6' and the vertical axis is assigned the luminance reduction rate calculated for each patch portion. Actually, this chart is generated as a correction table by connecting intermediate data by using approximate formula calculation and linear interpolation, and is stored in the ROM 112 as a product program. Since the pattern M1' is paper white, when the horizontal axis is assigned the colorimeter density of the pattern M1', the luminance reduction rate is 1.000. For all densities lower than or equal to the density of paper white, the luminance reduction rate is 1.000. Like the luminance-to-density conversion characteristic, density-luminance reduction rate characteristics for respective patch colors (Y, M, C, and K) are provided, and are a characteristic is selected from among the characteristics according to the patch color which is subjected to the density correction. More specifically, the above-described density H' after the luminance-to-density conversion is converted into a luminance reduction rate H" based on a density-luminance reduction rate characteristic of magenta. Likewise, the density I' after the luminance-to-density conversion is converted into a luminance reduction rate I". For the sake of the following descriptions, the luminance reduction rate for each division region is defined as En, where n is an integer from 1 to 16.

Acquiring the characteristics is equivalent to normalizing the above-described total reflection amount O with a quantitative scalar quantity. More specifically, when a case where the user image region 505 is paper white which is subjected to the largest amount of reflection, and a case where the user image region 505 has the highest density of the image forming apparatus 100 which is subjected to the least amount of reflection is considered, a ratio of the total reflection amount O in the former case to that in the latter case ranges from 0.952 to 1.000.

This means that the luminance decreasing rate may be any value from 0.952 to 1.000 according to the density of the user image.

(Step 4: Multiplying Distance Coefficient by Distance Area Coefficient)

The CPU 114 performs weighting according to a distance from the region A.

Figure 24:
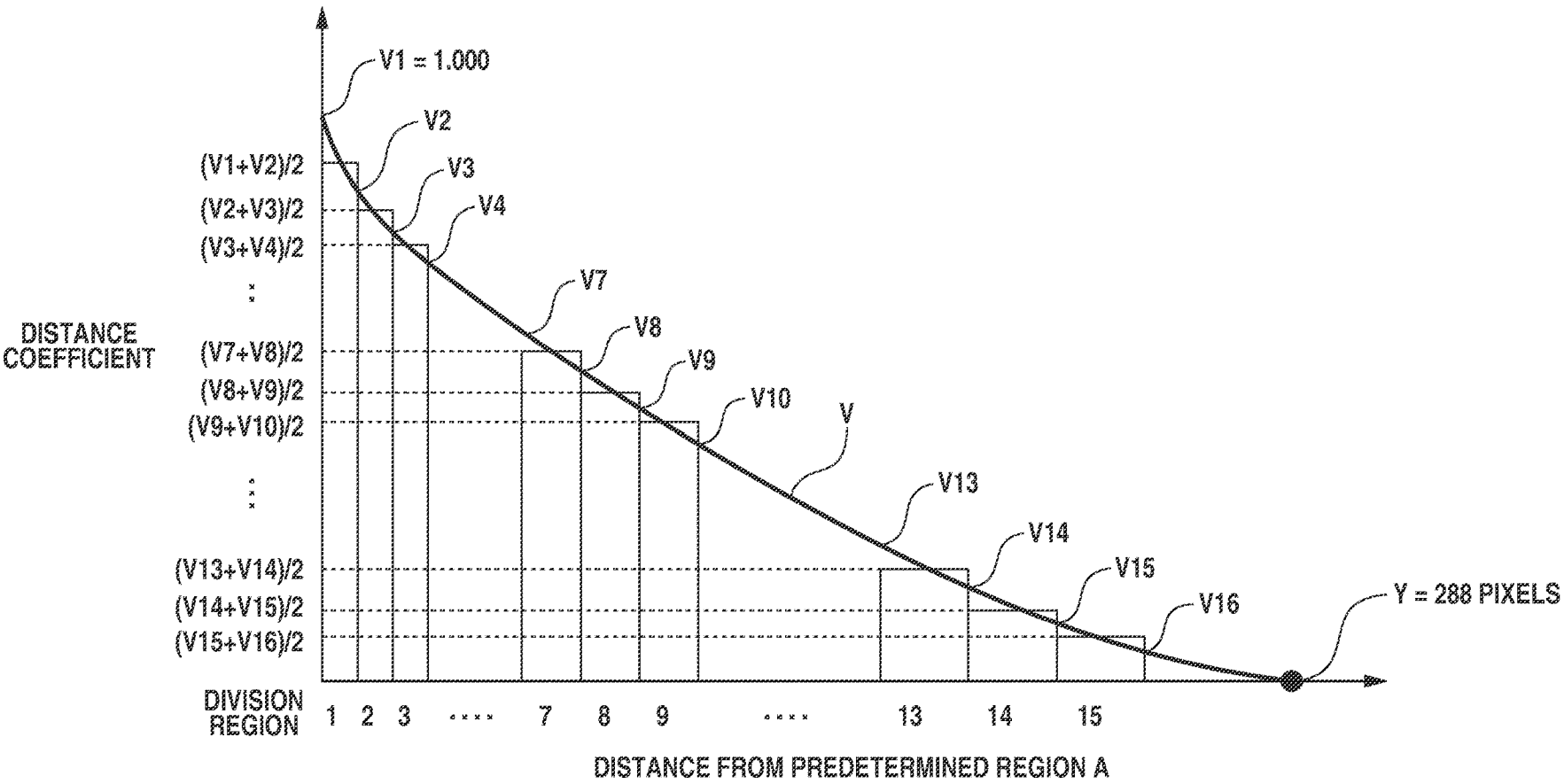
FIG. 24 is a chart illustrating distance characteristics of reflection.

FIG. 24 illustrates a distance coefficient characteristic of the reflection. The horizontal axis is assigned a distance from the region A, and the vertical axis is assigned a distance coefficient. Like the chart in FIG. 16, the solid line V indicates a distance coefficient when the user image region 505 is a white background region of paper. The distance coefficient refers to a characteristic in which the "reflection amount" assigned to the vertical axis in FIG. 16 is normalized to 1.000. Y denotes a range of the influence of the reflection and is 288 pixels according to the present exemplary embodiment. Vn (n=1 to 16) is a distance coefficient of the starting pixel in each division region, and is 0.000 at a position corresponding to V1=1.000 and Y=288 pixels. Since the distance characteristic of the reflection amount illustrated in FIG. 13 are known based on the development-time data, distance coefficients V2 to V16 are acquired by performing the normalization with V1=1.000. According to the present exemplary embodiment, since the CPU 114 processes a reflection amount for each division region, the CPU 114 acquires a distance coefficient Jn for each division region by using the following Formula 9:

$$\text{Distance coefficient } Jn \text{ for each division region} = (Vn + Vn+1)/2 \quad \text{(Formula 9)},$$

where n is an integer from 1 to 16.

For simplification, the CPU 114 uses an average value of distance coefficients corresponding to the starting pixel of each division region and the starting pixel of the next division region as a distance coefficient for each division region. However, the average value of each division region may be acquired based on the average value of distance coefficients of the starting and the ending pixels.

Further, since the main scanning width is different for each division region, the CPU 114 acquires a distance area coefficient for each division region Kn by using the following Formula 10 in consideration of the influence of the reflection on each division region:

$$\text{Distance area coefficient for each division region } Kn = Jn * \text{Division region pixel width} \quad \text{(Formula 10)},$$

where n is an integer from 1 to 16.

FIG. 25 illustrates examples of the distance coefficient and the distance area coefficient obtained as described above. These coefficients are stored in the ROM 112 as a product program. The CPU 114 performs weighting according to a distance from the region A by multiplying the above-described luminance reduction rate for each division region En by the distance area coefficient Kn.

$$\text{Luminance reduction rate after weighting } Pn = \text{Luminance reduction rate for each division region } En * \text{Distance area coefficient } Kn \quad \text{(Formula 11)},$$

where n is an integer from 1 to 16.

Lastly, the CPU 114 adds all of the luminance reduction rate after the weighting Pn to quantify a reflection amount Ptotal.

$$Ptotal = \sum_{n=1}^{16} (Pn), \quad \text{(Formula 12)}$$

where n is an integer from 1 to 16.

A method for calculating the reflection correction rate will be described below. The CPU 114 calculates the reflection correction rate Q based on the addition value Ptotal of the luminance reduction rate after the weighting Pn by using the following Formula 13:

$$Q = P\text{min}/P\text{total} \quad \text{(Formula 13)}.$$

The addition value Pmin of the luminance reduction rate after the weighting Pn when the user image region 505 has the highest density is a fixed value obtained by performing the above-described calculation in advance in a case where the user image region 505 has the highest density. A reflection correction rate Q is the multiplier applied to the average luminance value I (Aave) of the region A as the above-described correction target. More specifically, the reflection correction rate Q is minimized (Qmin=0.952) when Ptotal is maximized, i.e., when the entire user image region 505 is a white background. On the contrary, when the reflection correction rate Q is maximized (Qmax=1.000) when Ptotal is minimized, i.e., when the user image region 505 has the highest density. When Ptotal is maximized, the region A is in a state of being affected by the reflection to the maximum extent. Thus, the reflection correction rate Q is a scalar quantity which means that the average luminance value I (Aave) of the region A is corrected to a lower value by being multiplied by Qmin=0.954. On the other hand, when Ptotal is minimized, the region A is not affected by the reflection from the user image. Thus, the reflection correction rate Q is a scalar quantity which means that the average luminance value I (Aave) of the region A is not corrected by being multiplied by Qmax=1.000. Then, the luminance average value I (A'''ave) of the region A after the implementation of the reflection correction is calculated based on Formula 7.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-016512, filed Feb. 4, 2021, which is hereby incorporated by reference herein in its entirety.

What is claimed is:

1. A reading apparatus comprising:

a conveyance roller configured to convey a sheet;

a light source configured to illuminate the sheet conveyed by the conveyance roller;

a light transmission member configured to transmit reflected light from the sheet conveyed by the conveyance roller;

a line sensor configured to receive the reflected light from the sheet via the light transmission member while the sheet is being conveyed by the conveyance roller, wherein a predetermined direction in which a plurality of pixels of the line sensor is arranged is different from a conveyance direction in which the sheet is conveyed, wherein each of the plurality of pixels outputs output value based on a result of receiving; and a controller configured to:

acquire an output value of a first pixel included in the plurality of pixels of the line sensor, wherein a position of the first pixel in the predetermined direction corresponds to a position in a range where a pattern image on the sheet conveyed by the conveyance roller passes through in the predetermined direction;

acquire an output value of a second pixel included in the plurality of pixels of the line sensor, wherein a position of the second pixel in the predetermined direction is apart from the range where the pattern image on the sheet conveyed by the conveyance roller passes through in the predetermined direction, by a first distance;

acquire an output value of a third pixel included in the plurality of pixels of the line sensor, wherein a position of the third pixel in the predetermined direction is apart from the range where the pattern image on the sheet conveyed by the conveyance roller passes through in the predetermined direction, by a second distance longer than the first distance;

determine a first value based on the output value of the second pixel and a first coefficient for the first distance;

determine a second value based on the output value of the third pixel and a second coefficient for the second distance; and determine read data of the pattern image based on the output value of the first pixel, the first value, and the second value.

2. The reading apparatus according to claim 1, wherein the first coefficient is larger than the second coefficient.

3. The reading apparatus according to claim 1, wherein the image includes the pattern image and a user image transferred to an image forming apparatus by a user.

4. The reading apparatus according to claim 1, wherein a region where the pattern image is formed in the predetermined direction is a region between an edge of the sheet and the user image.

5. The reading apparatus according to claim 1, wherein the image includes the pattern image and a user image transferred to a forming apparatus by a user.

6. The reading apparatus according to claim 1, wherein the position of the third pixel in the predetermined direction corresponds to a position where the user image included in the image passes through in the predetermined direction.

* * * * *